US008756770B2

(12) United States Patent
Cina et al.

(10) Patent No.: US 8,756,770 B2
(45) Date of Patent: Jun. 24, 2014

(54) TOUCH FASTENING PRODUCT FACE CONFIGURATION

(75) Inventors: Michael Cina, Toronto (CA); David Nicholaus Zach, Toronto (CA); Earl Lorne Cowley, Ajax (CA); Patrick D. Todkill, Cambridge (CA); Daniel Lee Janzen, Brampton (CA); Stephane Xavier Girard, Toronto (CA)

(73) Assignee: Velcro Industries B.V., Willemstad, Curacao (AN)

( * ) Notice: Subject to any disclaimer, the term of this patent is extended or adjusted under 35 U.S.C. 154(b) by 12 days.

(21) Appl. No.: 13/583,833

(22) PCT Filed: Nov. 15, 2011

(86) PCT No.: PCT/IB2011/002861

§ 371 (c)(1),
(2), (4) Date: Sep. 10, 2012

(87) PCT Pub. No.: WO2012/066418

PCT Pub. Date: May 24, 2012

(65) Prior Publication Data

US 2013/0000085 A1 Jan. 3, 2013

Related U.S. Application Data

(60) Provisional application No. 61/414,576, filed on Nov. 17, 2010.

(51) Int. Cl.
*A44B 18/00* (2006.01)
*B32B 3/06* (2006.01)

(52) U.S. Cl.
USPC ..... 24/452; 428/99

(58) Field of Classification Search
None
See application file for complete search history.

(56) References Cited

U.S. PATENT DOCUMENTS 4,398,715 A * 8/1983 Hall ..... 473/501
4,842,916 A 6/1989 Ogawa et al.
5,067,210 A * 11/1991 Keyaki ..... 24/452

(Continued)

FOREIGN PATENT DOCUMENTS

AT 264770 B 9/1968
GB 2364351 B 4/2004

OTHER PUBLICATIONS

International Search Report for International Application No. PCT/IB2011/002861 mailed May 11, 2012.

(Continued)

*Primary Examiner* — Jack W. Lavinder
(74) *Attorney, Agent, or Firm* — Fish & Richardson P.C.

(57) ABSTRACT

A fastening product, in the form of a flexible, sheet-form substrate (102) having a surface (108); a plurality of walls (104) extending from the surface (108) and defining therebetween an array (114) of cells (116) bounded by the walls (104) such that the walls separate adjacent cells of the array, the substrate (102) forming a floor (122) of each cell; and a plurality of fastener elements (106) extending from the surface (108) and interspersed among the cells (116). The fastener elements having heads (130) spaced above the surface (108) to define loop engagement overhangs (134) disposed within the cells. The cells (116) of the array (114) are arranged in columns (124) and rows (126), each column and each row comprising at least three of the cells, such that there exists at least one closed path (136) within the substrate (102) that fully circumscribes at least one of the cells.

21 Claims, 16 Drawing Sheets

(56) References Cited

U.S. PATENT DOCUMENTS

| | | | | |
|---|---|---|---|---|
| 5,500,268 | A | 3/1996 | Billarant | |
| 5,579,562 | A | 12/1996 | Hattori et al. | |
| 5,688,576 | A | 11/1997 | Ohno et al. | |
| 6,730,069 | B2 * | 5/2004 | Tanzer et al. | 604/391 |
| 6,896,759 | B2 | 5/2005 | Fujisawa et al. | |
| 7,022,394 | B2 | 4/2006 | Fujisawa et al. | |
| 7,608,070 | B2 | 10/2009 | Chen et al. | |
| 7,998,548 | B2 | 8/2011 | Murasaki et al. | |
| 8,043,541 | B2 | 10/2011 | Nozawa et al. | |
| 2007/0098953 | A1 | 5/2007 | Stabelfeldt et al. | |

OTHER PUBLICATIONS

International Preliminary Report; May 30, 2013; World Intellectual Property Organization (WIPO) (International Bureau of); PCT/IB2011/002861; 6 pages.

International Preliminary Report and Written Opinion; May 11, 2012; World Intellectual Property Organization (WIPO) (International Bureau of); PCT/IB2011/002861; 9 pages.

* cited by examiner

TOUCH FASTENING PRODUCT FACE CONFIGURATION

CROSS REFERENCE TO RELATED APPLICATIONS

This application is a §371 National Stage Application of International Application No. PCT/IB2011/002861, filed Nov. 15, 2011, which claims priority to U.S. Provisional Application No. 61/414,576, filed Nov. 17, 2010, each of which is incorporated herein by reference in its entirety.

TECHNICAL FIELD

The present invention relates to touch fastening products, and more particularly to configurations of the fastening faces of male touch fastener products, such as for engaging fibrous surfaces in hook-and-loop fastening.

BACKGROUND

Traditionally, hook-and-loop fasteners comprise two mating components that releasably engage with one another, thus allowing coupling and decoupling of the two surfaces or objects. The male fastener portion typically includes a substrate having fastener elements, such as hooks, extending from the substrate. Such fastener elements are referred to as "loop-engageable" in that they are configured to releasably engage with fibers of the mating component to form the hook- and loop-fastening.

Among other things, hook-and-loop fasteners are employed to attach upholstery to car seat cushions, for example. Car seat cushions are typically made of a foam material. To attach the upholstery to the foam, one fastener product is incorporated at a surface of the foam car seat and the mating component is incorporated into the upholstery, or is provided by the upholstery itself. The male fastener elements releasably engage with the mating component to couple the upholstery to the foam car seat.

To incorporate a male fastener product into a foam cushion, the fastener product may be positioned within a cushion mold, such that as foam fills the mold to form the cushion, the foam adheres to the fastener product. Flooding of the fastener elements by the foam during forming of the cushion is generally seen as inhibiting the usefulness of the fastener elements, and so several improvements have been made to attempt to avoid such foam intrusion.

Further advances in the design of fastener products are sought, for this and for other applications.

SUMMARY

One aspect of the invention features a fastening product with a substrate, a plurality of walls, and a plurality of fastener elements. The substrate is a flexible, sheet-form substrate that includes a surface. The walls extend from the surface and define between them an array of cells bounded by the walls. The walls separate adjacent cells of the array, with the substrate forming a floor of each cell. The fastener elements extend from the surface and are interspersed among the cells. The fastener elements have heads spaced above the surface to define loop engagement overhangs disposed within the cells. The cells of the array are arranged in columns and rows, and each column and each row includes at least three of the cells, such that there exists at least one closed path within the substrate that fully circumscribes at least one of the cells.

In some configurations, the walls are continuous, such as continuous in two orthogonal directions.

In some embodiments, the walls are configured to form flow barriers between adjacent cells when the product is held against a flat surface with the fastener elements extending from the substrate toward the flat surface.

In some fastening products, the fastener elements are embedded in the walls, with heads of the embedded fastener elements extending into adjacent cells. In some examples, the fastener elements are embedded in the walls at wall intersections, such that heads of the embedded fastener elements extend into adjacent cells at corners of the adjacent cells.

For some applications, the walls are configured to define a maximum flow gap into the cells with the product held against a flat surface with the fastener elements extending from the substrate toward the flat surface. By maximum "flow gap" we mean the lateral dimension of a gap through which a fluid may flow, measured perpendicular to the direction of flow between the closest two opposing flow boundaries. In some examples, the flow gap is of less than about 0.1 millimeter.

In some implementations, the walls are taller than the fastener elements, as measured from the surface of the substrate. In such cases, the fastener elements are spaced from a flat mold surface against which the walls seal.

In some other configurations, the walls and fastener elements extend from the surface of the substrate to a substantially common height.

In some cases, some of the cells of the array each enclose multiple fastener elements.

For some applications, the cells of the array are staggered.

In some cases, only a subset of the cells of the array contain fastener elements, with other cells being void of fastener elements.

In some examples, some of the fastener elements are disposed completely within cells while others are embedded in cell walls.

In some instances, many of the fastener elements are each spaced from all of the walls.

In some cases, the heads of the fastener elements extend to distal tips. For some uses, the distal tips are preferably spaced a distance of at least 0.5 millimeter from a nearest one of the walls.

The substrate, the walls, and the fastener elements may together form a contiguous mass of a resin. The resin may be magnetically attractable, such as containing magnetically attractable particles. In some cases, a magnetically attractable component, such as a metal strip or wire, is secured to the substrate.

In some configurations, the substrate is formed of a first material and the walls and the fastener elements comprise a second material that differs from the first material. The first and second materials may be different resins, for example. In some cases, the first material is magnetically attractable and the second material is not.

In some applications, the fastener elements are flexible. This can be useful, for example, in applications in which the fastener elements are slightly taller than the walls, and flex under the force of magnetic attraction against a mold surface, to bend to allow the walls to contact the mold surface. It can also be useful for engagement and retention of some types of loop materials.

In some fastening products, the array is of a honeycomb configuration.

In some other implementations, the array is of a diamond configuration. In some diamond configurations, the fastener elements are disposed within associated cells and have flat sides that are not aligned in parallel with walls forming their associated cells.

In some embodiments, adjacent cells of the array are spaced apart from one another, such that they do not share a common wall, for example. A gap between the walls bordering adjacent cells can be used as a foam flow path to further secure the fastener in a molded foam product In some instances, each fastener element head extends in two opposite directions to define two separate loop engagement overhangs.

In some cases, the cells are rectangular.

In some applications, the walls define wall intersections that each form a common corner for four adjacent cells.

The fastening product may also include, for some uses, a backing laminated to a surface of the substrate opposite the fastener elements.

Another aspect of the invention features a mold-in fastener product for incorporation into a foamed article. The fastener product includes a substrate, a plurality of intersecting walls, and a plurality of fastener elements. The substrate is flexible and includes a surface and lateral edges forming a perimeter bounding the surface. The walls extend from the surface and to all of the lateral edges of the substrate. The walls both enclose cells spaced from the perimeter of the surface, and partially bound cells open at the lateral edges of the surface. The substrate forms a floor of each enclosed cell and each open cell. The fastener elements extend from the surface and are interspersed among the enclosed and open cells. The fastener elements have heads spaced above the surface to define loop engagement overhangs disposed within the enclosed cells and to define foam anchor points within the open cells along the lateral edges of the substrate.

In some implementations, some of the lateral edges intersect walls at an acute angle (i.e., a non-zero angle less than 90 degrees).

In some examples, the product is magnetically attractable.

In some cases, the flexible substrate includes a flexible, magnetically attractable resin.

In some applications, some of the walls are continuous across the array, such as continuous in two orthogonal directions.

In some configurations, at least some of the fastener elements are embedded in the walls, with the heads of the embedded fastener elements extending into adjacent cells.

As discussed above, in some instances the walls are configured to define a maximum flow gap of less than about 0.1 millimeters.

In some embodiments, the walls are taller than the fastener elements, as measured from the surface of the substrate.

In some other embodiments, the walls and fastener elements extend from the surface of the substrate to a substantially common height.

In some applications, many of the cells of the array each enclose multiple fastener elements.

In some implementations, only a subset of the cells of the array contain fastener elements, with other cells not containing any fastener elements.

In some embodiments, many of the fastener elements are each spaced from all of the walls.

For some applications, the heads of the fastener elements extend to distal tips. The distal tips are spaced a distance of at least 0.5 millimeter from a nearest one of the walls, for example.

In some cases, the substrate, the walls and the fastener elements together form a contiguous mass of a resin, such as a magnetically attractable resin.

In some configurations, each fastener element head extends in two opposite directions to define two separate and discrete loop engagement overhangs.

In some instances, the walls define wall intersections that each form a common corner for four adjacent cells.

In another aspect of the invention, a fastener product includes a substrate, a plurality of walls, and a plurality of fastener elements. The substrate is a flexible, sheet-form substrate having a surface and lateral edges forming a perimeter bounding the surface. The walls extend from the surface defining an array of cells between the walls. The cells are bounded by the walls such that the walls separate adjacent cells of the array, with the substrate forming a floor of each cell. The fastener elements extend from the surface and are interspersed among the cells, and the fastener elements have heads spaced above the surface to define loop engagement overhangs disposed within the cells. The cells of the array are arranged in intersecting rows and columns, and each row and each column consists of multiple cells.

In some implementations, the walls extend to at least one of the lateral edges of the surface to partially bound cells open at the lateral edges of the substrate. In some cases, the walls extend to all of the lateral edges of the substrate, such as to form open cells on more than one lateral edge. In some cases, at least some of the open cells contain fastener elements or severed portions of fastener elements.

In some configurations, two opposite edges of the substrate are spaced from the array of cells to define open substrate flanges that have neither walls nor fastener elements.

In some examples, some of the lateral edges intersect walls at an acute angle.

In some cases, the product is magnetically attractable. For example, the flexible substrate may be formed of a flexible, magnetically attractable resin.

The walls may be continuous across the array in at least one direction, or in two orthogonal directions.

At least some of the fastener elements may be embedded in the walls, with heads of the embedded fastener elements extending into adjacent cells.

In some applications, the walls are configured to define a maximum flow gap, as discussed above.

In some embodiments, the walls are taller than the fastener elements, as measured from the surface of the substrate.

For some applications, many of the cells of the array each enclose multiple fastener elements.

In some fastener products, only a subset of the cells of the array contain fastener elements.

In some implementations, many of the fastener elements are each spaced from all of the walls.

In some configurations, the substrate, the walls and the fastener elements together form a contiguous mass of a resin.

In some instances, each fastener element head extends in two opposite directions to define two separate loop engagement overhangs.

In some products, the walls define wall intersections that each form a common corner for four adjacent cells.

Some fastener products also include a backing laminated to a surface of the substrate opposite the fastener elements. In some cases, the backing extends beyond at least some lateral edges of the substrate. The backing may extend beyond all of the lateral edges of the substrate.

Another aspect of the invention features a method of forming a fastener. The method includes providing a flexible, sheet-form product and severing the product. The product has a substrate, a plurality of walls, and a plurality of loop-engageable fastener elements. The substrate has a surface and lateral edges forming a perimeter bounding the surface. The walls extend from the surface and define between them an array of cells bounded by the walls such that the walls separate adjacent cells of the array. The substrate forms a floor of each cell. The fastener elements extend from the surface and are interspersed among the cells, and have heads spaced above the surface to define loop engagement overhangs disposed within the cells. The product is severed to form a discrete fastener having a perimeter defined by severed edges of the substrate, with the walls both enclosing cells spaced from the perimeter of the fastener and extending to the perimeter of the fastener to partially bound cells of the array open at the severed edges.

In some implementations, at least some of the open cells at the severed edges contain loop engagement overhangs that define foam anchor points at the perimeter of the fastener.

In some embodiments, the product is severed by die cutting.

In some instances, severing the product severs walls at all of the severed edges, such as to form open cells at all of the severed edges.

In some cases, the discrete fastener, as formed by severing the sheet-form product, is magnetically attractable.

In some applications, the sheet-form product is molded as a continuous sheet of resin.

Another aspect of the invention features a method of forming a foamed article. The method includes placing the above-described fastener product into a mold cavity, introducing a foaming resin into the mold cavity, and removing a foamed article from the cavity. The introduced resin expands to both fill the mold cavity and intrude into the open cells of the fastener product, such as to fill the open cells with the resulting foam. The foaming resin forms a foamed article having the fastener product embedded at a surface of the foamed article.

The product is preferably positioned in the mold cavity such that the walls of the product inhibit flow of the foaming resin into the enclosed cells of the product.

In some embodiments, the product is placed in the mold cavity with distal edges of the walls contacting a mold surface bounding the mold cavity.

In some occurrences, the product is placed into a trench defined within a mold wall bounding the mold cavity. The perimeter of the substrate may be of a shape selected in accordance with a shape of the trench. In some other examples, the product is placed against a flat surface not within a trench, such as against a flat upper surface of a pedestal extending into the mold cavity.

In some example, the distal edges of the walls of the product are left exposed in a surface of the foamed article.

Various implementations of the invention can be useful in the engagement of fibers and/or other types of surfaces to form releasable fastenings. In particular applications, such as those in which a fastener product is to be embedded in a molded surface of another material, the arrangement of walls can help to prevent material intrusion into the area around the fastener elements. The arrangement of such walled cells in arrays having at least three cells in each direction across a broad fastening material allows discrete products to be severed from the material while leaving at least one closed cell within each product. By making the individual cells relatively small in comparison with the products to be cut from the material, there can be advantageous flexibility in the shapes of products that can be cut from one material. In other words, tooling costs can be avoided by having to produce only a single configuration of starting material from which many shapes of products may be severed. Furthermore, the presence of partial cells at the edges of pieces severed from such materials can advantageously enhance the connection of such severed products molded into larger articles, such as foam cushions. The arrangement of walls across the field of fastener elements can also, for some applications in which the tactile feel of the fastening product face is important (as in diaper tabs, for example), reduce the perceived roughness of the fastening face as compared to a similar surface without interconnecting walls.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
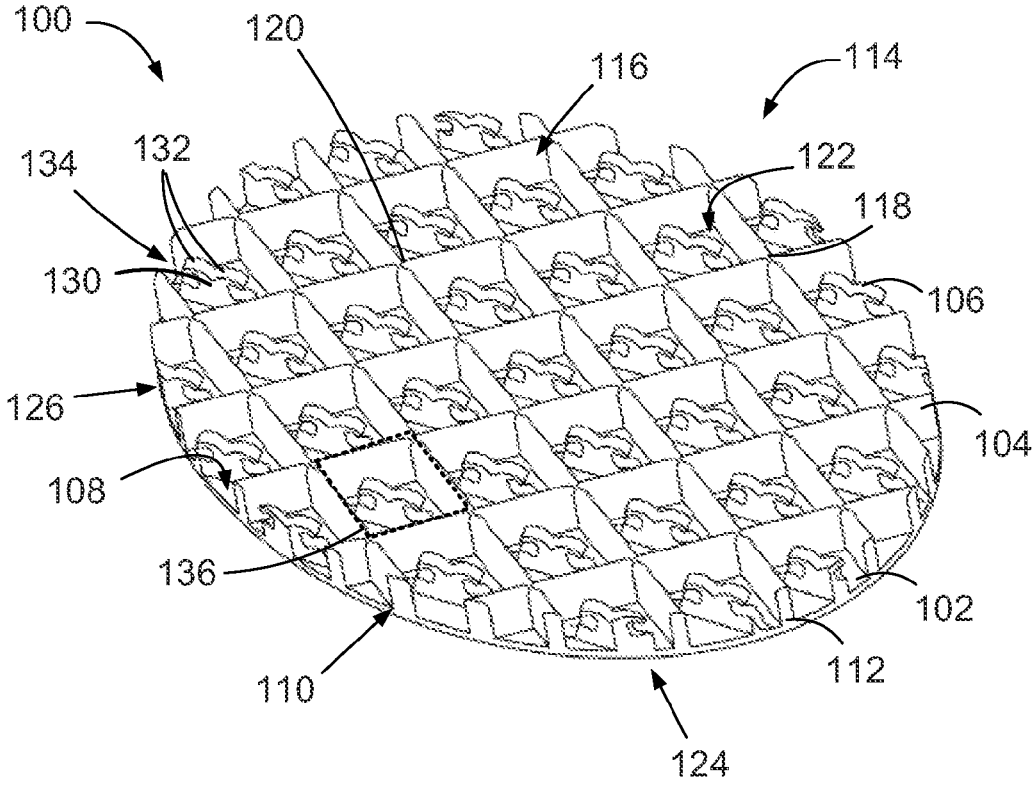
FIG. 1 is a perspective view of a fastening product.

Referring to FIG. 1, a fastening product 100 has a substrate 102, walls 104, and fastener elements 106. The substrate is a flexible sheet and has an upper surface 108 with lateral edges 110 that form a perimeter 112 around the upper surface. The walls are continuous and extend integrally from the upper surface to form an array 114 of cells 116. The cells are bounded by the walls and the walls separate adjacent cells, forming intersections 118 within the array. Each intersection forms a common corner 120 of four adjacent cells. The substrate forms a floor 122 of the cells, which are rectangular and arranged in columns 124 and rows 126. Each column and each row has three or more cells. Product 100 includes many complete cells spaced from the edges of the product. One such complete cell is shown bounded by a set of walls 136. Other cells, at the edges of the product, are partial in that they are not completely bounded by the walls.

The fastener elements 106 are flexible and extend upward from upper surface 108 of substrate 102, interspersed among cells 116. Each of the fastener elements has a head 130 spaced above the upper surface of the substrate, and each head has two distal tips 132 that extend in opposite directions to form loop engagement overhangs 134 within the cells. Thus, the fastener elements are configured to releasably engage fibers of a mating component (not shown) to form a hook-and-loop fastening.

In this example, substrate 102, walls 104, and fastener elements 106 are formed as a contiguous mass of magnetically attractable resin, such that fastening product 100 is attracted by a magnet to hold it against a surface of a mold, as discussed in more detail below.

Figure 2:
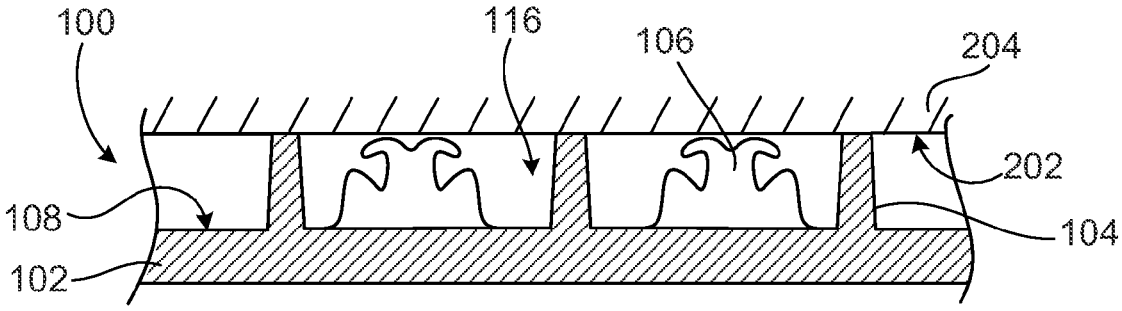
FIG. 2 is a side view of the fastening product of FIG. 1, pressed against a mold surface, with the fastening elements shown schematically.

Referring to FIG. 2, fastening product 100 may be held against a flat surface 202 of an object 204, such as an interior surface of a mold. When the fastening product is held against the flat surface, walls 104 contact the flat surface to form flow barriers between adjacent cells 116 to inhibit flow into the complete, internal cells of the fastening product. The flow barriers formed by the walls minimize, if not prevent, any flow of material that would otherwise enter circumscribed cells 116. In this example, the walls are of about the same height as fastener elements 106, as measured from upper surface 108 of substrate 102. In another example, the walls are taller than the fastener elements, as measured from the upper surface of the substrate, forming a flow gap between the fastener elements and the flat surface. The fastener elements may be of the palm-tree type, having two tips 132 that extend in opposite directions, as shown in FIGS. 1 and 2. Alternatively, the fastener elements could be of the J-hook type, having only a single head that overhangs in a given direction, or a mushroom-type fastener having a head that overhangs in generally all directions. Such mushroom-type fastener elements may be formed, for example, by molding discrete stems and then heading the stems by application of heat and/or pressure to deform resin of the distal ends of the stems to form the overhanging heads. The fastener elements shown in FIGS. 1 and 2 are of a structure and shape disclosed more fully in U.S. Pat. No. 7,516,524, the entire contents of which are hereby incorporated by reference.

Figure 3:
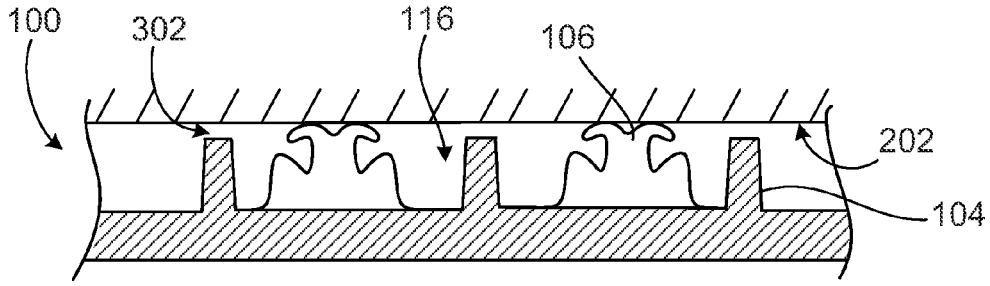
FIG. 3 is a side view of a similar fastening product, having walls and fastener elements of a substantially common height.

Referring to FIG. 3, in another example walls 104 are slightly shorter than fastener elements 106. In some such examples, the fastener elements are sufficiently flexible that force attracting fastener product 100 to flat surface 202 is sufficient to bend the fastener elements to bring the walls into contact with the flat surface to form a sufficient flow barrier. In some other such examples, the walls do not contact the flat surface but leave a very small flow gap 302 (e.g., on the order of 0.1 mm or less in thickness) between the walls and the flat surface, small enough to impede foam intrusion into interior cells 116 of the fastener product and maintain a desired level of fastening performance.

In these examples, substrate 102 has a thickness of approximately 0.3 millimeters, walls 104 each have a thickness of approximately 0.3 millimeters and extend a distance of approximately 1.8 millimeters from upper surface 108 of the substrate. Fastener elements 106 each have a lateral thickness of about 0.4 millimeter. Cells 116 each have dimensions of approximately 3.5 millimeters by 3.5 millimeters, as measured between the inner wall surfaces of the cell. Distal tips 134 of fastener elements 106 are spaced a distance of approximately 0.7 millimeter from a nearest wall 104, leaving sufficient gap for fibers to enter the cells for engagement.

Figure 4:
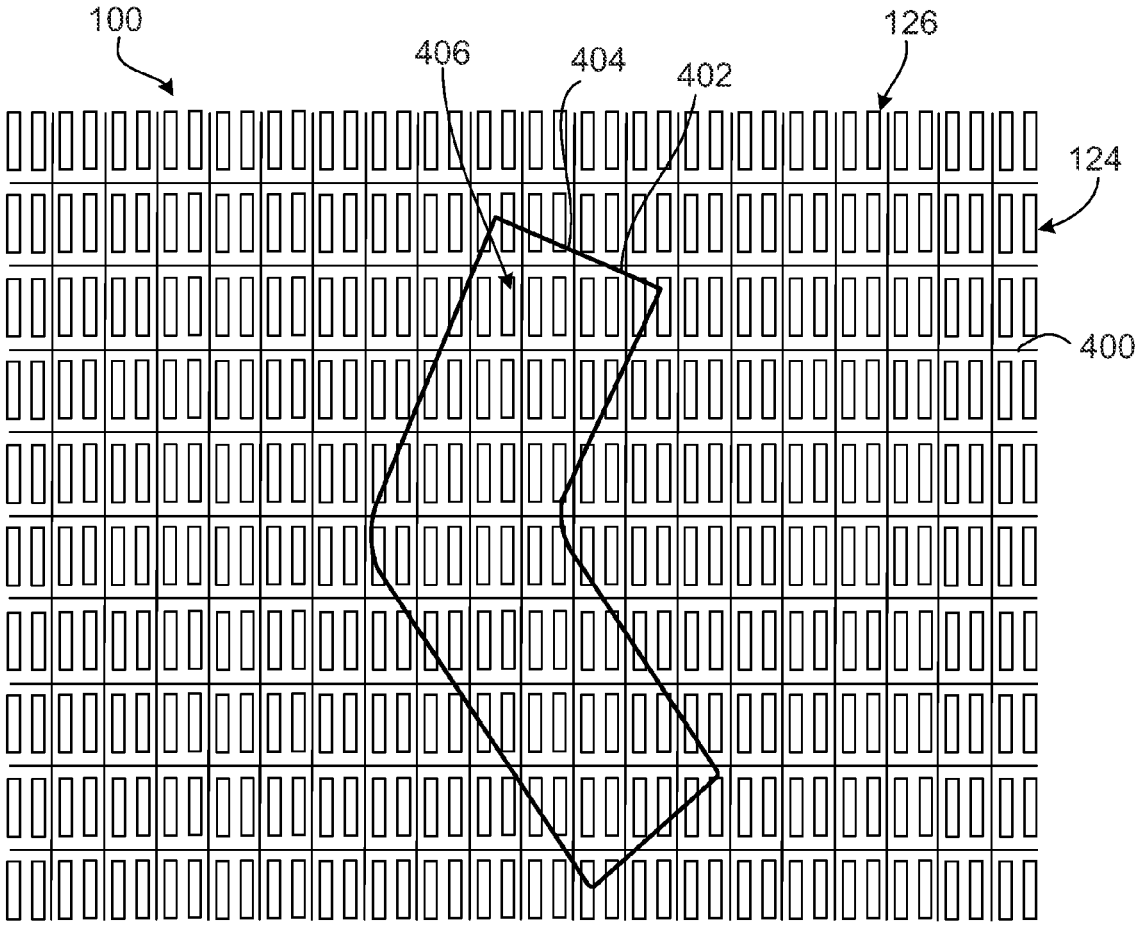
FIG. 4 is a top view of a fastening product, illustrating a die cutting profile.

As illustrated, the edges of fastener product 100 of FIG. 1 indicate that the fastener product has been severed from a larger sheet, the cutting having bisected cells 116 at the edge of the fastener product to leave incomplete cells and even partial fastener elements 106 at the product edges. FIG. 4 shows a broad sheet of fastener material 400 of a different arrangement of the cells and the fastener elements, upon which has been superimposed a die cutting profile 402 that corresponds to a perimeter of a discrete fastening product 404 to be severed from the fastener material by cutting the material along the die cutting profile. Because the material has at least three cells in each row 124 and column 126, or at least three cells across its extent in each of two orthogonal directions, there exists at least one closed path (e.g., profile 402) within the material that fully circumscribes at least one closed cell 508. The severing of the discrete, bounded product from sheet 400 may be done by die cutting or laser cutting, for example.

Figure 5:
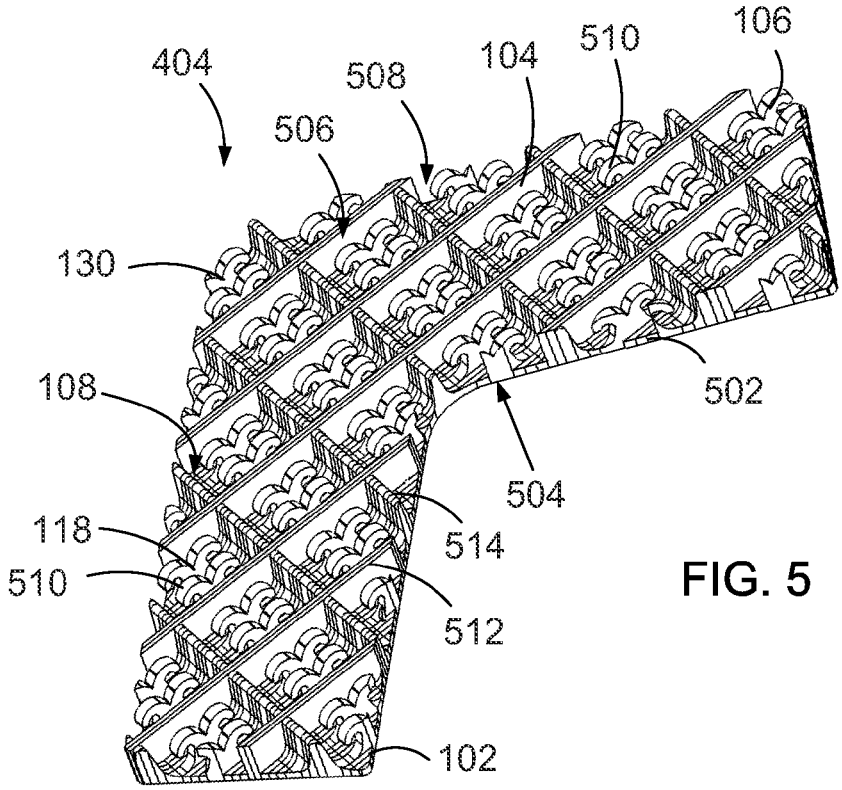
FIG. 5 is a perspective view of a discrete mold-in fastener product cut from the fastening product sheet along the die cutting profile of FIG. 4.

Referring to FIG. 5, discrete fastening product 404 has lateral edges 502 that form a perimeter 504 surrounding upper surface 108 of substrate 102. As shown, the perimeter of the substrate is of an irregular shape, which may be specifically configured to correspond with a desired fastening area in a final product. As in the product shown in FIG. 1, walls 104 are arranged in array 114 coextensive with the upper surface of the substrate in all lateral directions of the upper surface, extending to all sides of the perimeter. The fastener product has closed cells 506 spaced from its perimeter, and open cells 508 at its perimeter. Closed cells 506 are enclosed by the walls and are spaced apart from the perimeter of the upper surface of the substrate. Open cells 508 are partially enclosed by the walls and are open at the lateral edges of the upper surface of the substrate. Within the open cells, heads 118 of partial or complete fastener elements 106 form anchor points 510 for foam that intrudes into such open cells during formation of a seat cushion, for example.

In the product shown in FIG. 5, each closed cell 506 contains two complete fastener elements 106, positioned side-by-side with a space between them. The cell walls 104 include a series of parallel walls 512 extending in parallel to fastener elements 106 and forming longer sides of cells 116 and a series of transverse walls 514, intersecting the parallel walls at right angles and forming shorter sides of the cells. The fastener elements and the walls shown in this arrangement may be molded contiguously with the substrate 102 in a continuous roll molding method such as that introduced by Fisher and described in U.S. Pat. No. 4,775,310, the entire contents of which are hereby incorporated by reference. In this process, discussed in more detail below with respect to FIGS. 16 and 17, the parallel mold rings forming the molding roll would extend in a direction corresponding with the longer side walls of the cells, such that those walls would each be formed in a circumferential molding recess about the molding roll, while the transverse walls would be formed in channels extending parallel to the axis of the molding roll and formed by aligned recesses in multiple, adjacent mold rings. In this example, the transverse walls are each of the same height as the longitudinal walls, and each side wall of each closed cell has a continuous upper surface, with no apertures or recesses defined in any wall of a closed cell.

In this example, cells 116 each have dimensions of approximately 3 millimeters by 4 millimeters, as measured by the inner wall surfaces of the cell.

Figure 6:
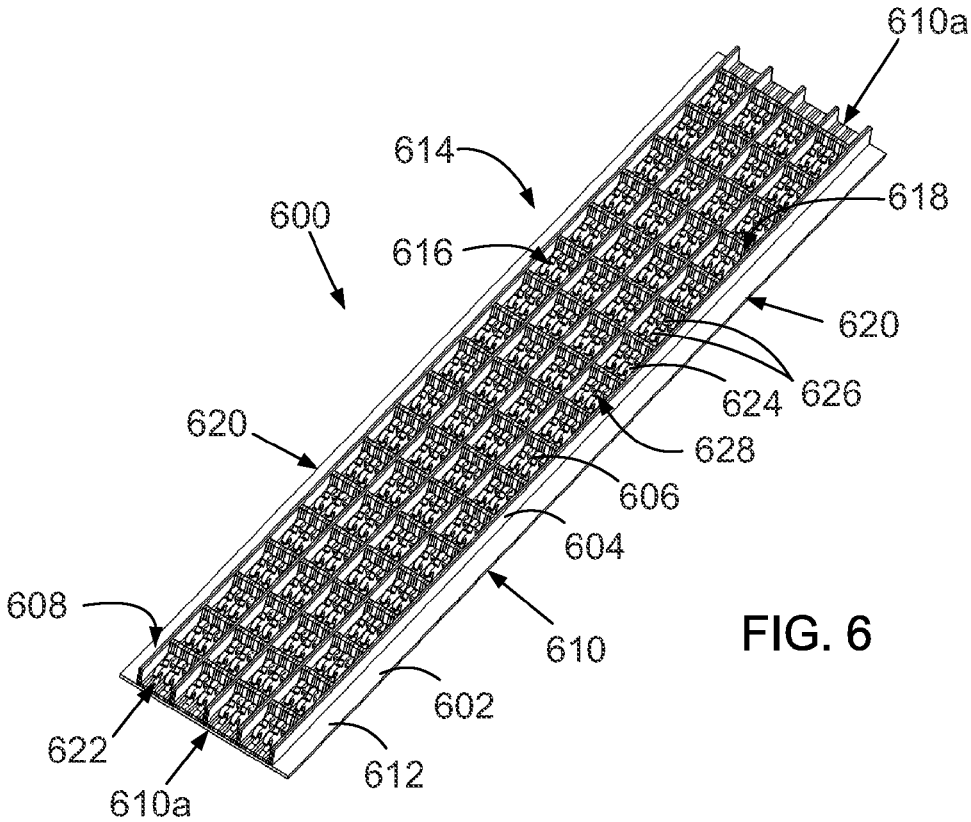
FIG. 6 is a perspective view of a mold-in fastener product having open longitudinal edges.

Referring next to FIG. 6, another mold-in fastener product 600 is formed as a longitudinally continuous, strip-form product and has a substrate 602, walls 604, and fastener elements 606. The substrate is a flexible sheet and has an upper surface 608 with lateral edges 610 that form longitudinal sides 612 of the substrate. The walls extend integrally from the upper surface of the substrate to form an array 614 of cells 616 between the walls, with multiple cells in each row extending between the longitudinal sides of the strip-form product. The walls separate adjacent cells and the substrate forms a floor 618 of the cells. The cells of this product are essentially of the same construction discussed above with respect to FIG. 5, and each contains two, side-by-side fastener elements. In this strip-form product, however, the array is spaced apart from the longitudinal edges of the substrate, leaving cell-free, open longitudinal selvedges 620. These selvedges provide a continuous channel for anchoring the longitudinal edges of the product, and permit a flow of foam along the product during molding. Such selvedges may also be configured to rest against the edges of a mold channel in which the product is placed, with the outer longitudinal walls of the product helping to position the product within the channel. This particular product is intended to be cut to length, such that the lateral edges 610*a* of the product may feature open cells 622 that may help to anchor the product into a flowable material, as discussed above. Because the cells along the longitudinal sides of the product are all closed, a great proportion of the fastener elements of the product remain protected from foam fouling. Even though this product is intended to be used at its full width, rather than having discrete pieces die cut from within its area, it is still useful to have at least three closed cells across its width (this example shows four closed cells across the width of the strip) in order to insure that even if the outer columns of closed cells are fouled by foam there will be at least one inner column of cells in which the fastener elements will remain engageable.

As in the previous examples, fastener elements 606 of product 600 extend upward from upper surface 608 of substrate 602 and are interspersed among cells 616. Each of the fastener elements has a head 624 spaced above the upper surface of the substrate, and each head has two distal tips 626 that extend in opposite directions to form loop engagement overhangs 628 within the cells. Thus, the fastener elements are configured to releasably engage fibers of a mating component (not shown), to form a hook-and-loop fastening.

Figure 7:
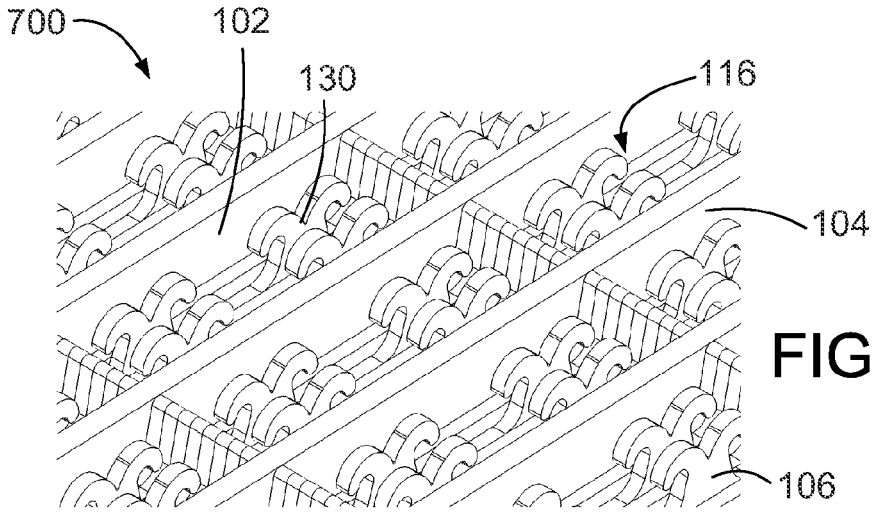
FIGS. 7-9 are enlarged perspective views of mold-in fastener products showing different configurations of fastener elements positioned within cells.

In further examples, the fastener elements 106 of the fastening product 100 are arranged in various configurations with respect to the cells 116. Referring to FIG. 7, a fastening product 700 has an arrangement of elongated cells 116 enclosed by walls 104 such that, as with the products of FIGS. 1-6, the fastener elements are completely disposed within respective cells. In this example, each cell contains four discrete fastener elements, each rising separately from substrate 102 of the product and spaced from the other fastener elements of the cell. Each fastener element head 130 is, in turn, spaced from all walls of the cell. In this example, the fastener element heads facing the middle of the cell are spaced a distance $X_2$ of about 1.7 millimeters from each other, while the fastener element heads facing the transverse walls are spaced a distance $X_3$ of about 0.6 millimeter from the walls they face.

Figure 8:
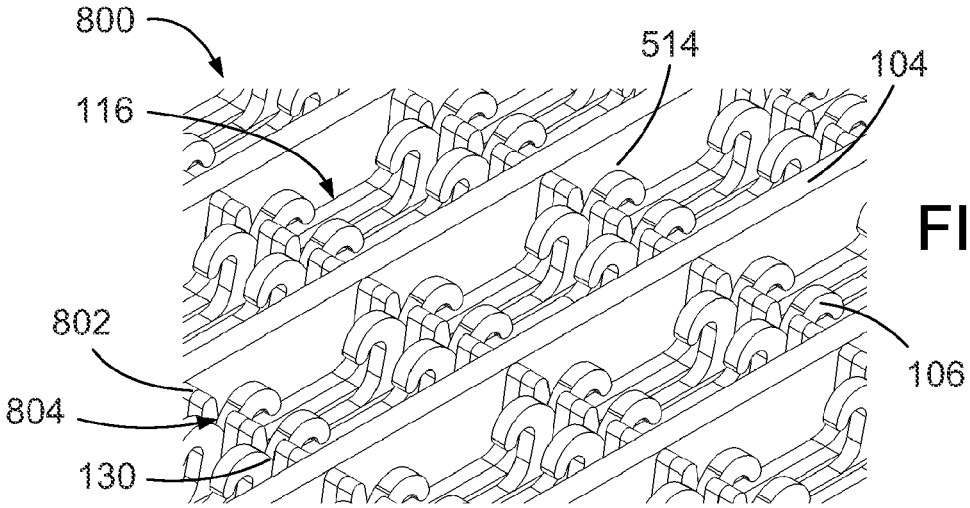

Referring to FIG. 8, a fastening product 800 has fastener elements 106 that are, in a sense, embedded in the walls 104, with the heads 130 of the embedded fastener elements 106 extending into adjacent cells 116. It may also be said that the fastener elements of this example, rather than being disposed completely within a respective cell, form part of transverse walls 514 separating adjacent cells of a given longitudinal column of cells. The heads 130 of the fastener elements face each other across the cell, separated by a distance $X_4$ of about 1.7 millimeters. Thus, the entire central area of each cell is open to receive loop fibers of a mating component. For some applications, this arrangement may enhance the initial engagement of fastener elements with fibers.

Because of the central recess at the top of head 130 of each fastener element 106, each transverse wall 104 has a small recess 802 corresponding to each fastener element. Because of this, upper surface 804 of each lateral wall is not continuous across the width of cells 116 it separates. If one of those adjacent cells is open and therefore exposed to flowing foam, such a recess above each fastener element should be kept sufficiently small to impede foam flow into any closed cell. Because the heads of the fastener elements in this example extend to a height approximately equal to the height of the traverse wall segments, any longitudinal flow through the recess above the fastener element will have to alter course to flow into the adjoining cell. Such forced flow direction changes help to aid in inhibiting flow.

The enlarged view of FIG. 8 also helps to illustrate the arrangement of mold rings with which product 800 is formed. Each fastener element 106 is molded in a given mold ring of the same thickness as the fastener element. The four fastener elements embedded in the two transverse walls 104 shown in the figure are formed in two mold rings spaced apart by two spacer rings in which are formed the short transverse wall segments connecting the fastener elements in each transverse wall. Another two spacer rings on either side of that set of rings, along with one wall-forming ring, complete a course of rings that is repeated to form each column of cells.

Figure 9:
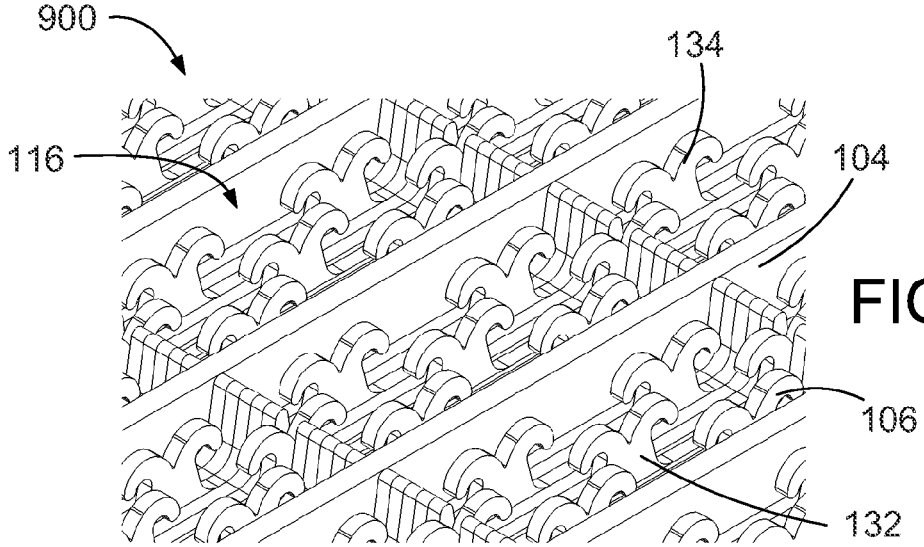

Referring next to FIG. 9, a fastening product 900 demonstrates a combination of the features of the products of FIGS. 7 and 8. Each cell 116 in product 900 contains five discrete fastener elements 106 spaced from the cell walls 104, and also includes portions of two additional fastener elements embedded in the walls, such that each cell features twelve discrete loop engagement points 134 formed by the overhanging tips 132 of the fastener elements. Furthermore, the rows of fastener elements 106 interspersed among the cells of product 900 are staggered, such that laterally adjacent fastener elements are offset from one another. This arrangement helps to maintain a constant draw of resin into the molding nip during forming and can provide more consistent flexure properties across the product. In some cases, such an arrangement may also enhance loop engagement.

Figure 10:
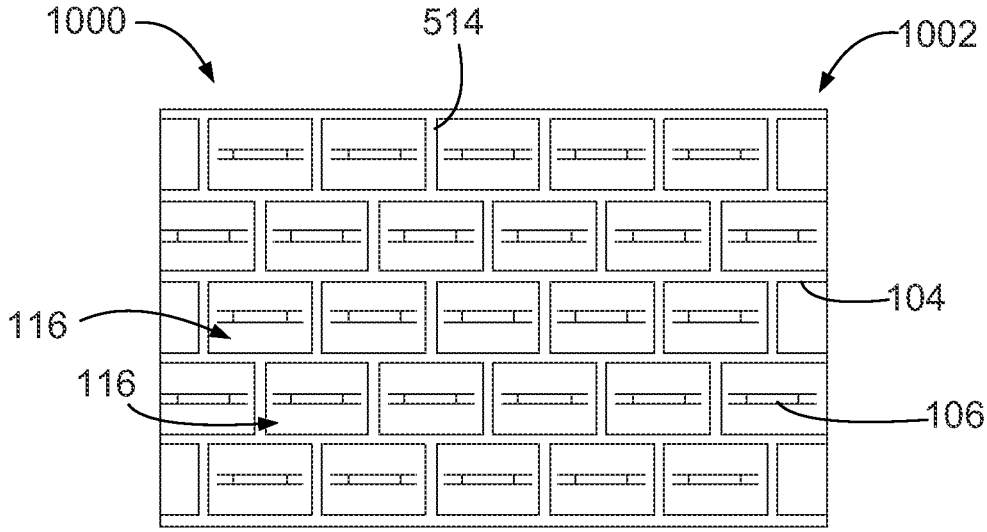
FIG. 10 is a schematic top view of an array of cells arranged in a staggered pattern.

In each of FIGS. 1-9, the cells 116 of the product are arranged such that each intersection between walls 104 forms corner 120 between four cells, but other arrangements are also envisioned. Referring to FIG. 10, for example, a product 1000 has hook cells 116 arranged in a staggered array 1002. In this example, each wall intersection forms the corner between three adjacent cells, and each cell contains a solitary fastener element 106 spaced from all walls 104 as in FIG. 1. Transverse walls 514 in this example are discontinuous or, in another sense, the adjacent cell columns are staggered.

Figure 11:
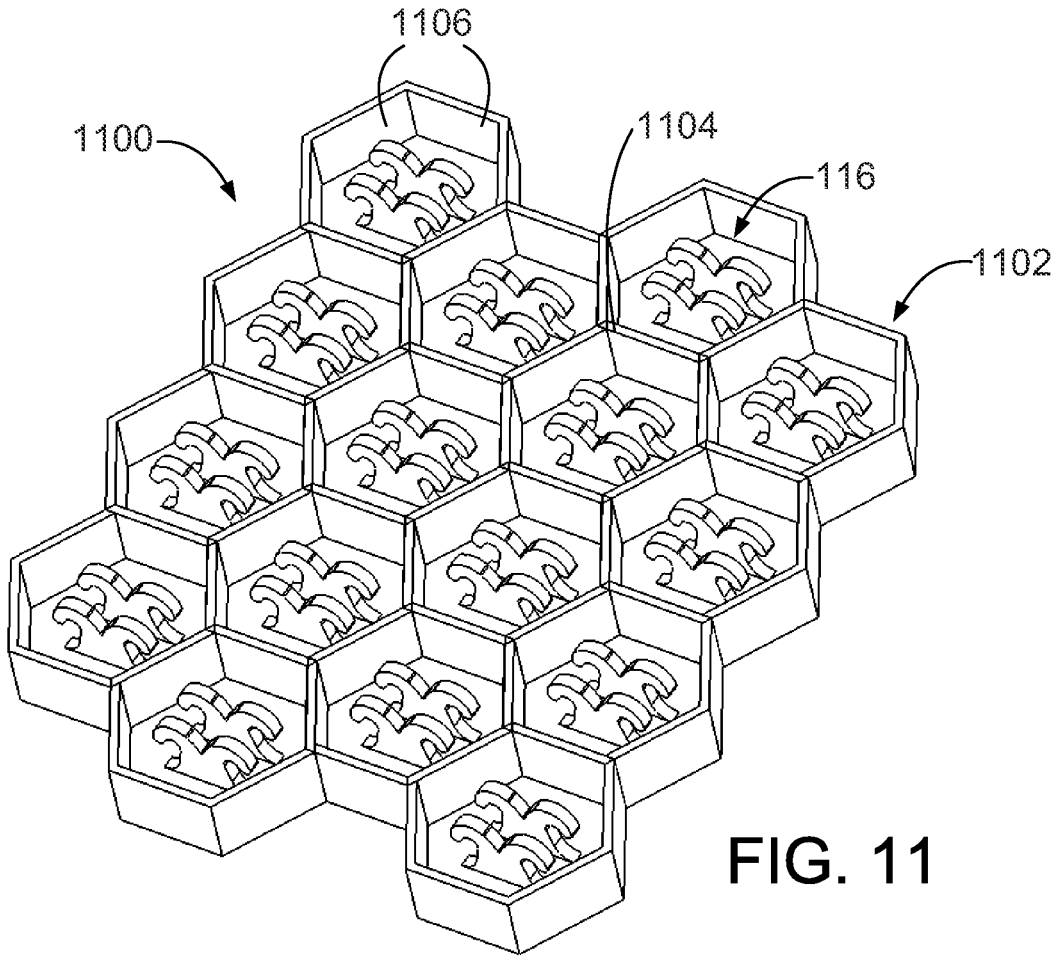
FIG. 11 is a schematic perspective view of an array of cells arranged in a honeycomb pattern.

FIG. 11 illustrates a product 1100 having a cell array 1102 in a honeycomb pattern, each cell 116 having six sides and six corners, each corner 1104 common to three cells. Each cell contains two side-by-side fastener elements 106, running parallel to some of the wall segments. In this example, there are no continuous parallel 514 or transverse 516 walls, but each cell is bounded by a set of wall segments 1106 that forms a continuous upper bound around the cell. This array would be considered appropriate for a large fastener sheet from which discrete fastener products would be severed, with at least many of the hexagonal cells at the perimeter of the product being severed and opened by the formation of the discrete product.

Figure 12:
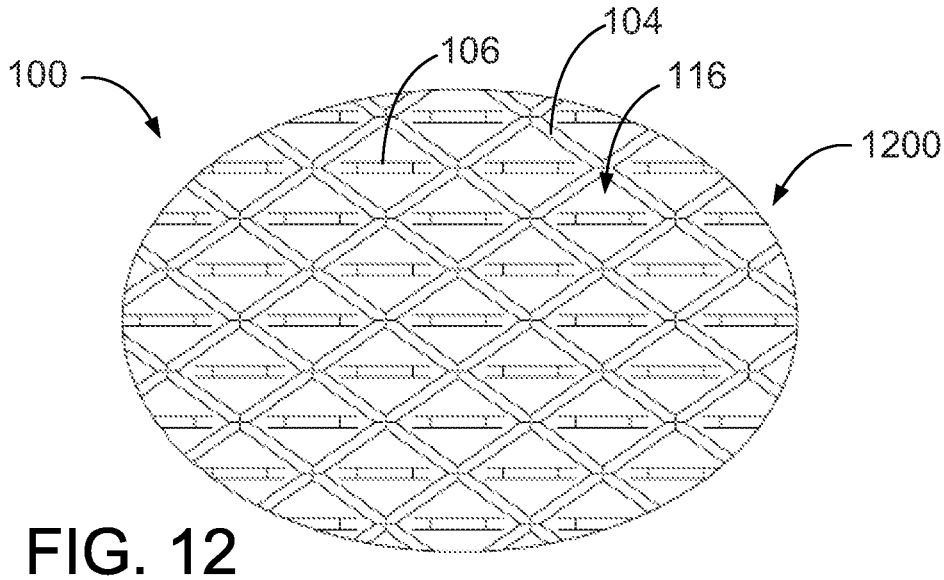
FIG. 12 is a top view of an array of cells arranged in a diamond pattern.
Figure 26:
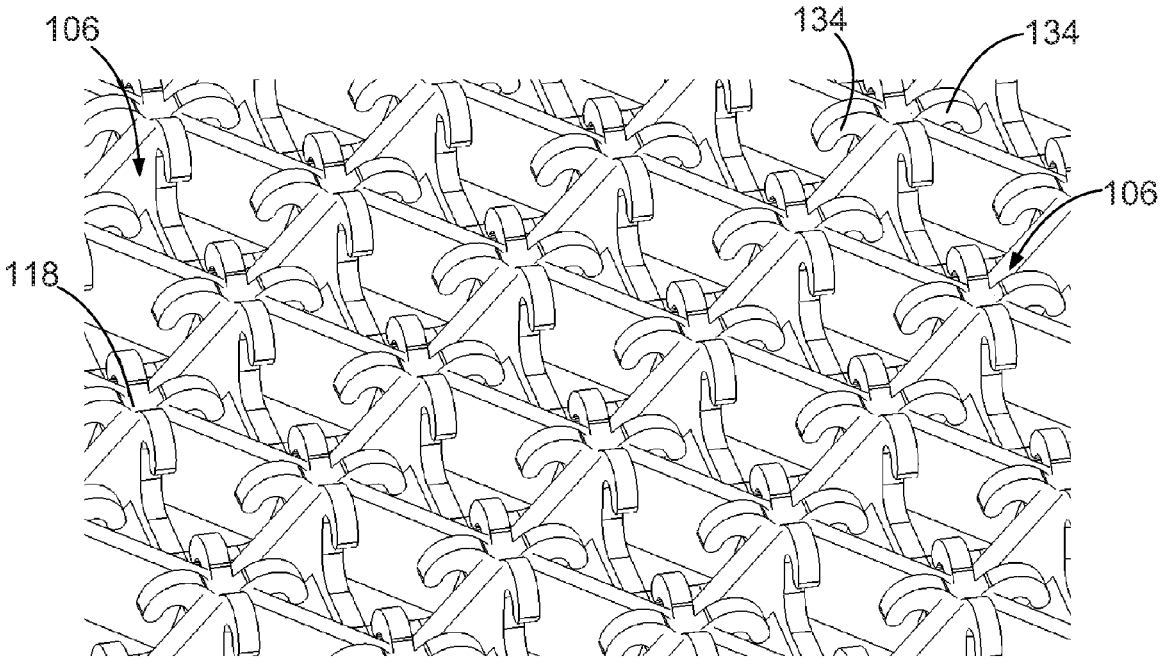
FIG. 26 is an enlarged perspective view of the fastener product of FIG. 25.
Figure 27:
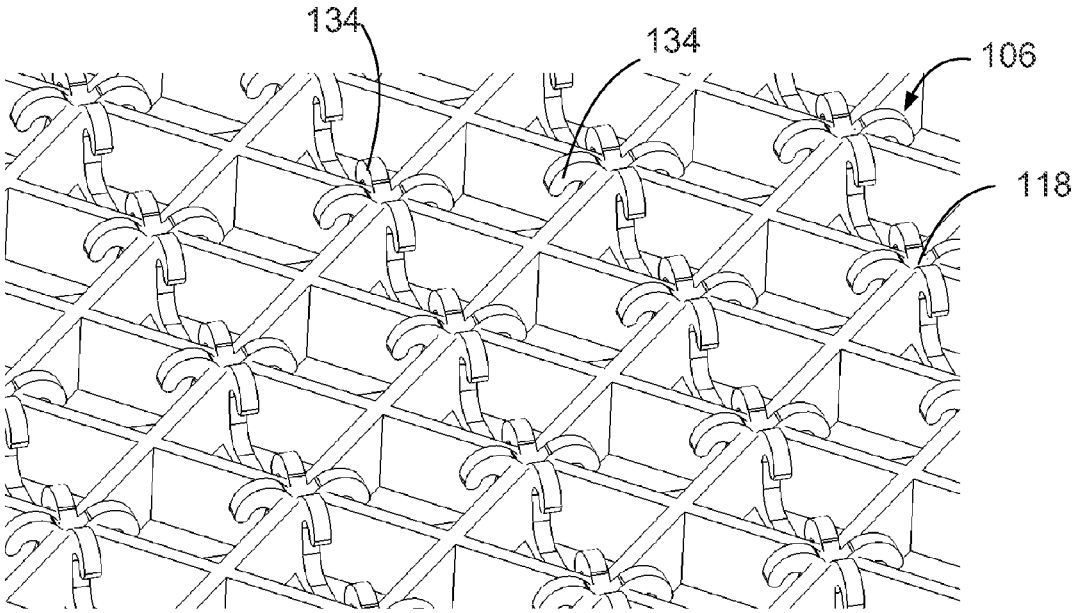
FIG. 27 is an enlarged perspective view of a fastener product with a diamond pattern of cells and hooking members at alternate wall intersections.

FIG. 12 illustrates again the array configuration of the product of FIG. 1, in which cells 116 are arranged in a diamond pattern 1200. In this example, each fastener element 106 is aligned with what would be considered the machine direction of the product, but none of the walls 104 are aligned with the machine direction, such that the fastener elements are not parallel to any wall segment. This alignment of the fastener elements with the diagonal of each cell may maximize the distance 'X' in front of each exposed hook tip, to give space for loop penetration and engagement. In some further examples, the diamond pattern of the fastening product includes fastener elements 106 positioned at the cell wall intersections. For example, the products of FIGS. 25-28 each have fastening element 106 with loop engagement overhangs 134 extending into the cells at each cell wall intersection 118. Each cell features four cell wall intersections, each with a respective loop engagement overhang. The overhangs of the fastener elements face each other across each cell, separated by a distance of about 1.7 millimeters in the examples of FIGS. 26-28. The entire central area of each cell is open to receive loop fibers of a mating component. For some applications, this arrangement may enhance the initial engagement of fastener elements with fibers. FIG. 27 illustrates the fastening elements positioned only at two opposing cell wall intersections 118 of each cell, such that each cell features only two loop engagement overhangs.

Figure 28:
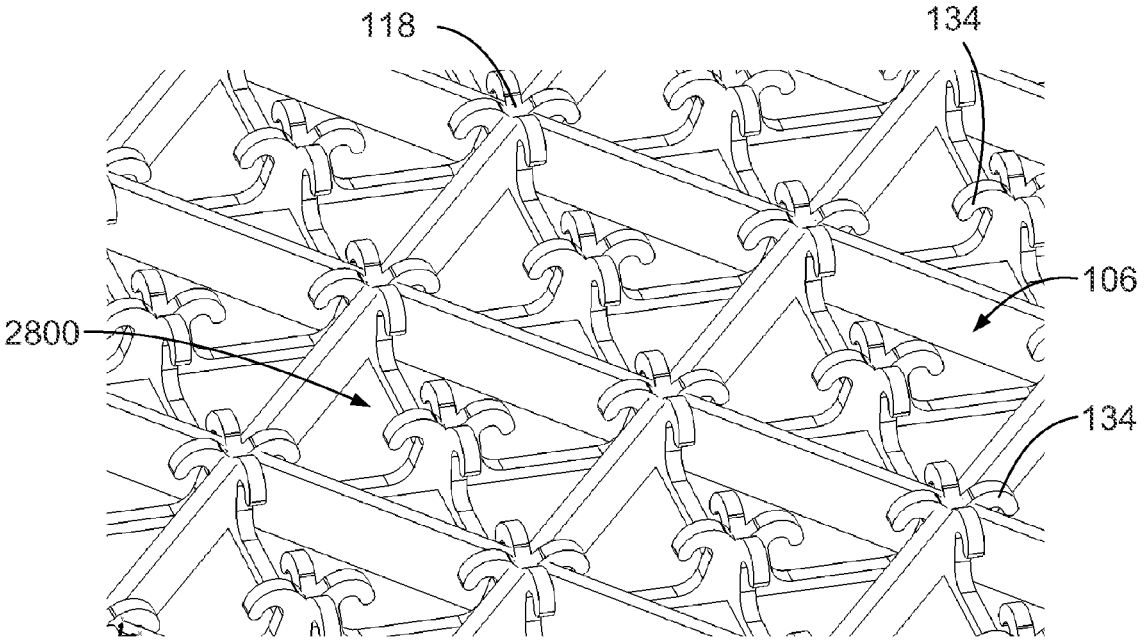
FIG. 28 is an enlarged perspective view of a fastener product with a diamond pattern of cells and hooking members at each wall intersection and in the middle of each cell.

Not all of the hook overhangs need be associated with adjoining walls. For example, FIG. 28 illustrates a fastener product with some fastener elements positioned at the intersections of the cell walls (as in FIG. 27), and others centrally located within area 2800 of the cells. Thus, each cell includes eight loop engagement overhangs, four at the intersections and four in the central area. The loop engagement overhangs of the fastener element in the central area are positioned facing the intersections and thus further face the loop engagement overhangs at the respective intersections.

Figure 13:
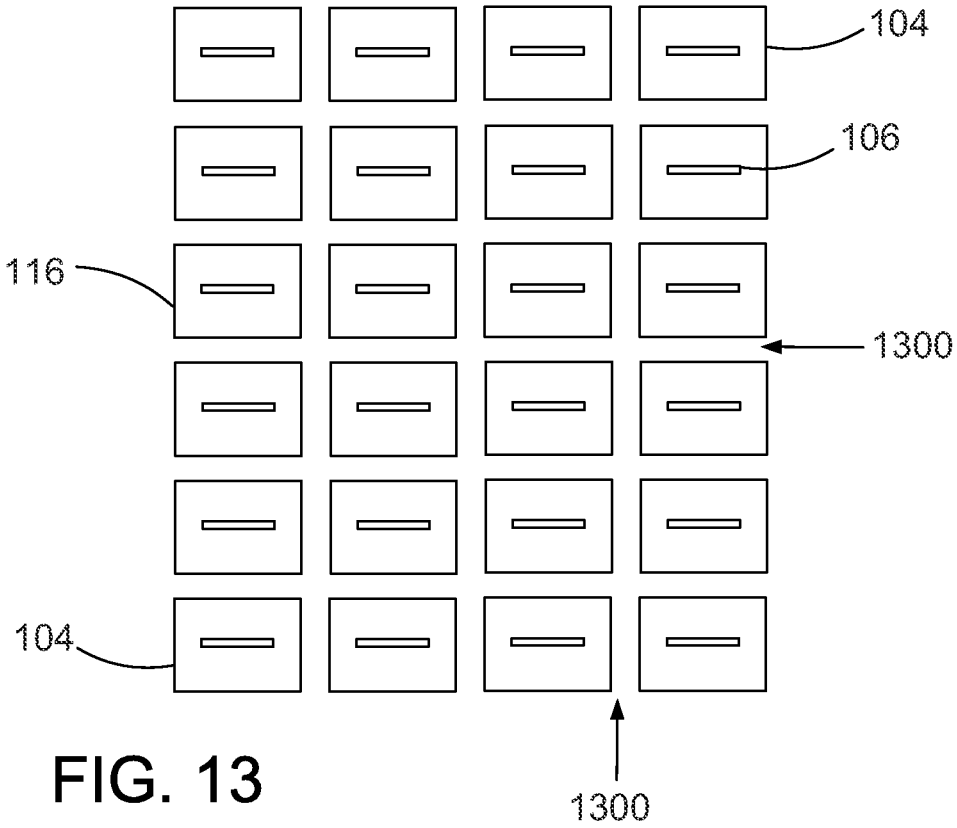
FIGS. 13 and 14 are top down views of arrays of cells in which adjacent cells are spaced apart from one another.

In each of the figures discussed so far, the wall segments have each formed wall surfaces of two adjoining cells 116. However, in some cases walls 106 may be arranged with adjacent walls forming channels 1300 therebetween running between closed cells. For example, FIG. 13 shows an array 1302 of closed cells 116 in which adjacent cells are spaced apart. Each wall in this figure is represented by a thin line, with the adjacent walls separated by a channel width 'W' of about 0.25 millimeter. Otherwise, the product dimensions, including wall thickness and height, are as in other illustrated embodiments. Each cell is shown as containing a single fastener element 106. Channels 1300 can further enhance embedding of the product into a flowable material, such as during foaming or other insert molding process, as the flowable foam can travel along the channels and further secure the fastener product to the finished foam surface.

Figure 14:
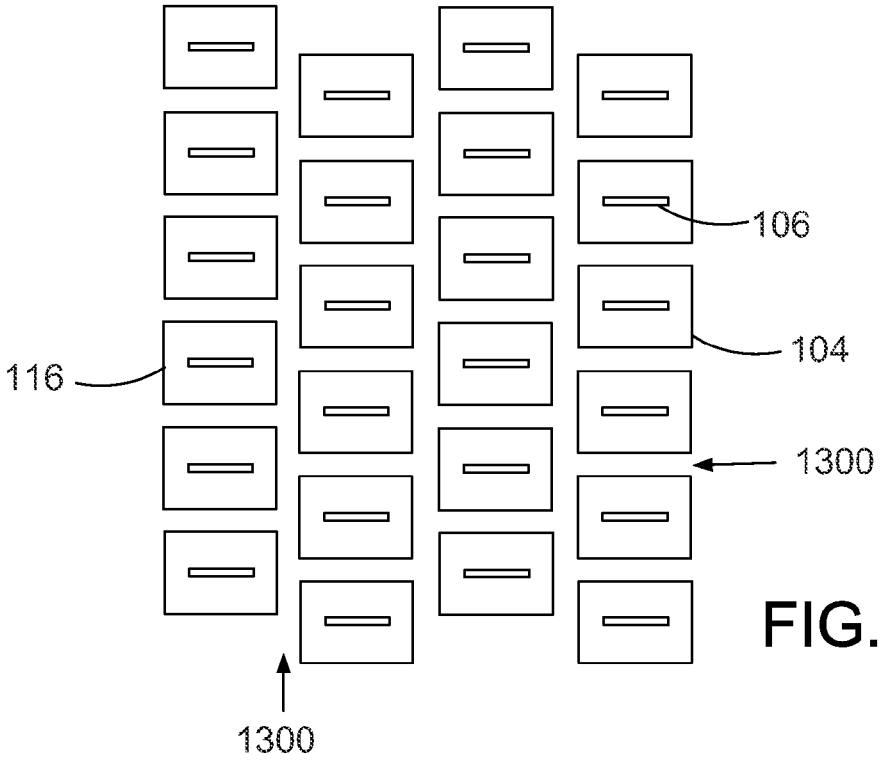

FIG. 14 shows a similar array, but with the closed cells 116 arranged in a staggered pattern. This arrangement provides for straight, clear flow channels 1300 running vertically in the figure, with the flow channels running across the figure broken into discrete channel segments.

Figure 15:
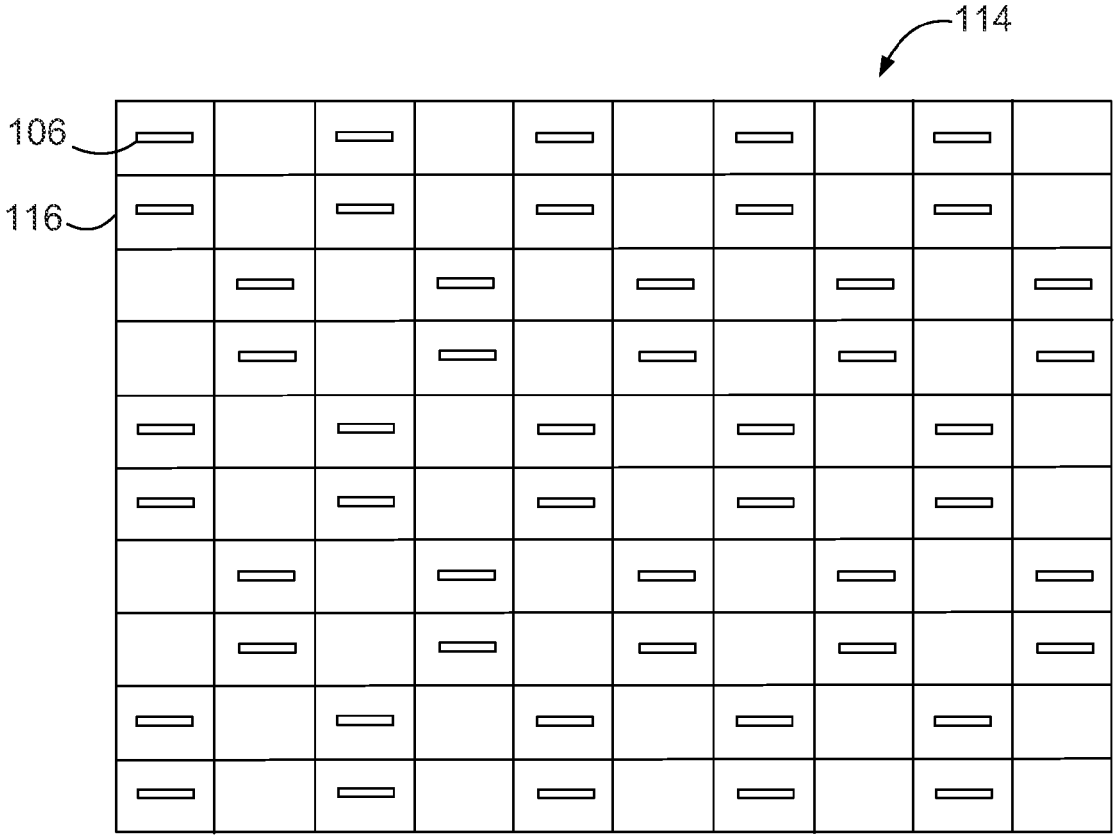
FIG. 15 is a top view of a fastening product in which only a subset of the cells contain fastener elements.
Figure 29:
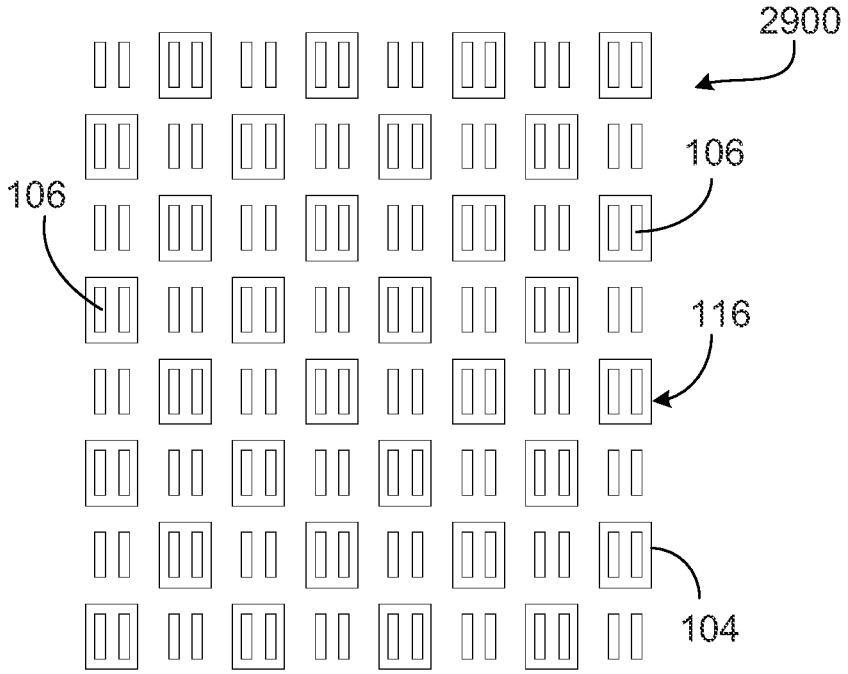
FIG. 29 is a top schematic view of a fastening product in which only a portion of the fastener elements are included in cells.
Figure 30:
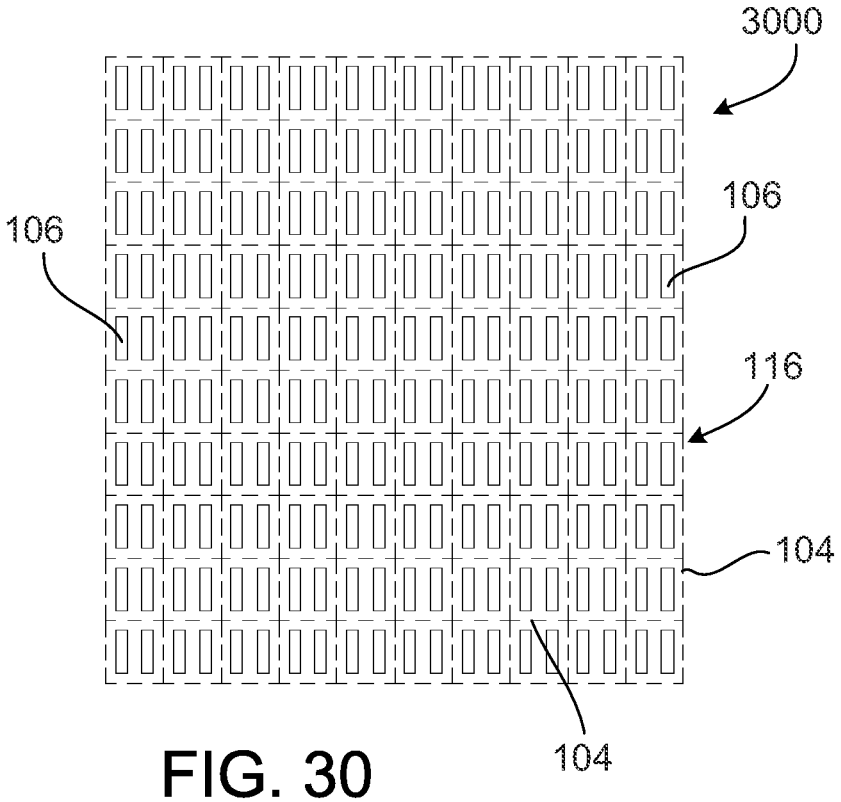
FIG. 30 is a top schematic view of a fastening product having disjointed cell walls.

The cells 116 of these fastener products can be configured of various sizes and shapes, and may each contain one or more plurality of fastener elements 106 in a variety of arrangements. In some cases, some cells may even be void of the fastener elements. For example, FIG. 15 shows an array 1502 in which only a subset of the cells contain the fastener elements, the other cells being empty. Such empty cells may be arranged, for example, in accordance with the outline of a part to be severed from the material, to avoid cutting through fastener elements or such that the open cell portions at the perimeter are void of partial fastener elements. In some other cases, some of the faster elements are not disposed within bounded cells. For example, FIG. 29 shows an array 2900 in which every other pair of fastener elements is disposed within a respective, rectangular cell, leaving the other fastener elements not surround by walls 104 and exposed to the flowable foam material. Leaving a subset of the fastener elements outside of any cells may be done to facilitate adherence of the fastener product to the flowable foam material, in the case of a mold-in fastener product. In the fastener products described above, the walls of the cells are substantially continuous and non-broken, save where they intersect with fastener elements. In some other cases, the walls are discontinuous or perforated. FIG. 30 illustrates a fastener product 3000 in which the cell walls define narrow passages between adjacent cells. While such a wall structure can provide enhanced flexibility of the substrate, when such walls are intended to block a flow of foaming resin, for example, it is important that the overall width of such passages be kept particularly low, in order to impede or limit foam flow between cells. In one example having passages through the full height of the walls, the lateral width of each passage is less than about 0.004 inch (0.1 mm).

In each of the arrays of cells 116 discussed above, including those shown in FIGS. 11-15, it can still be said that the cells are arranged in rows 124 and columns 126, with at least three cells in each row and column. In some cases, the cells of a given row or column are not directly adjacent one another, and the cells of a given row or column need not be in precise alignment. For example, the cells of the array shown in FIG. 11 could be said to be arranged in four straight, linear columns and four undulating rows essentially perpendicular to the columns.

Figure 31:
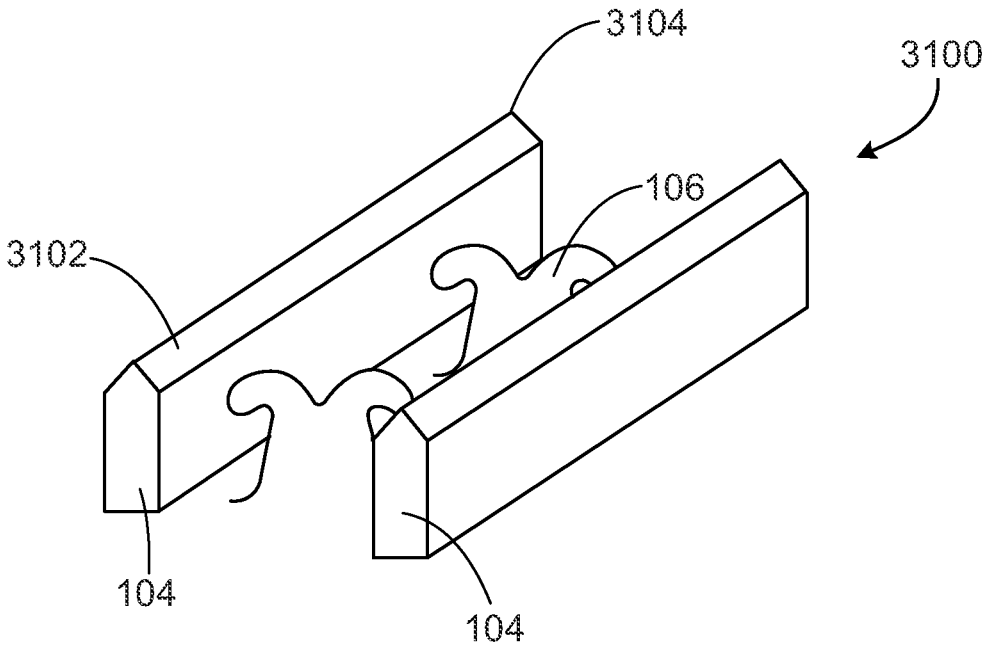
FIG. 31 is a perspective view illustrating cell walls having angled top surfaces.

The upper surfaces of the walls may be shaped in different manners for different applications. In some of the already described examples, the tops of the walls are generally flat, such as for face-to-face sealing against a mold wall. In some other examples, such as those intended to be touched by skin, the upper wall surfaces may be rounded. In some other examples, such as is illustrated by FIG. 31, walls 104 have angled top surfaces. In this illustration, the walls 104 of fastener product 3100 have angled upper surfaces 3102 that meet to form an apex 3104 at the center of each wall. The angled top surfaces extend the length of the walls. For simplicity of illustration, only walls extending along a first direction are shown.

Figure 16:
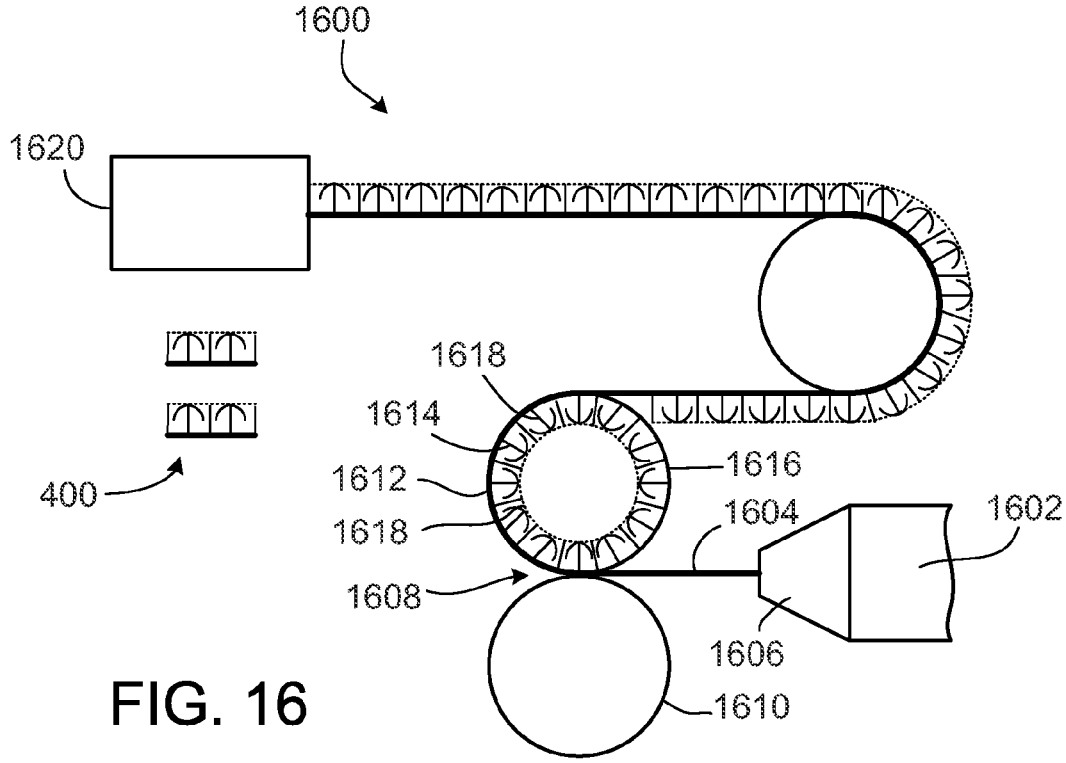
FIG. 16 is a side view of an apparatus for forming the fastening product.

As mentioned above, the fastener materials disclosed herein may be formed as flexible, continuous strips or sheets of material in a continuous roll molding process. Referring to FIG. 16, manufacturing apparatus 1600 has an extruder barrel 1602 that melts and forces a molten resin 1604 through a die 1606 and into a nip 1608 between a pressure roller 1610 and a cavity roller 1612. Cavity roller 1612 has cavities 1614 defined about its perimeter 1616 that are shaped to form the fastener elements 106 of the product, and other cavities 1618 that are configured to form the walls 104 of the product, as substrate 102 is formed on the outer surface of the cavity roller. Pressure in the nip forces the molten resin into the various cavities, leaving some resin remaining on the cavity roller surface. The resin travels around the cavity roller, which is chilled to promote resin solidification, and the solidified product is then stripped from the cavity roller by pulling the solidified fastener elements and walls from their respective cavities. The fastener elements, walls and their respective cavities are illustrated schematically and are not to scale. In many cases the cavity roller will be of a diameter of between 30 and 50 centimeters, and the fastener elements and walls will be less than 0.5 millimeter in height, to give a sense of perspective.

After the continuous length of fastening material is formed, it moves through a die-cutting station 1620, where discrete fastener products 400 are sequentially severed from the material. The remaining fastener material may be discarded or, in some cases, ground up and recycled to make further material.

Figure 17:
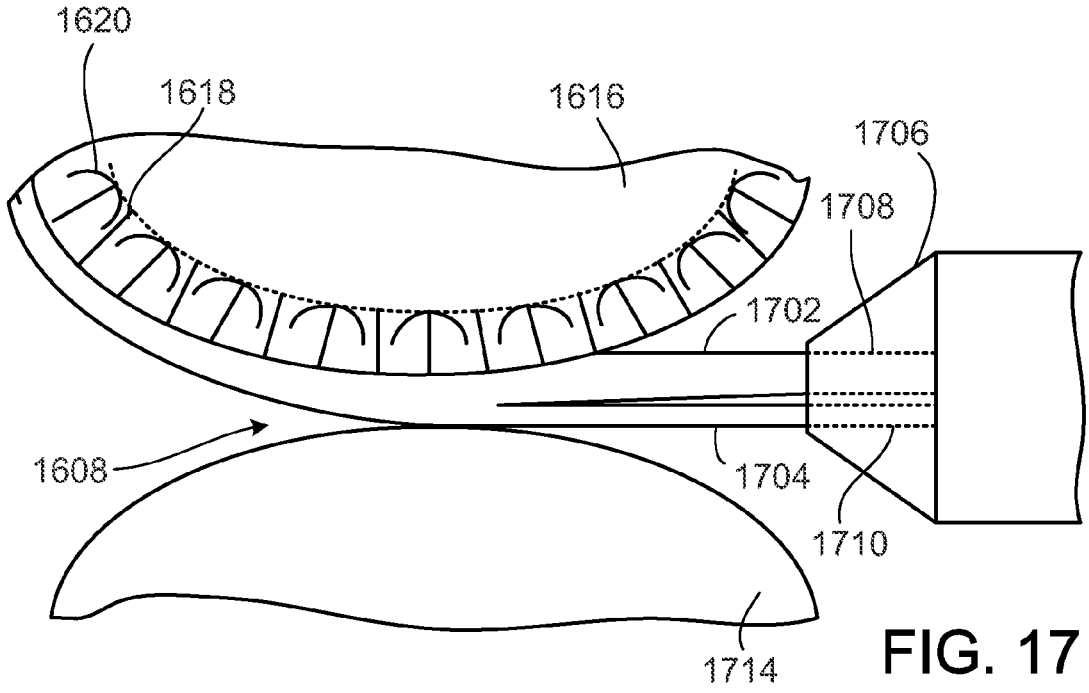
FIG. 17 is a side view of an apparatus for forming the fastening product as a coextrusion.
Figure 18:
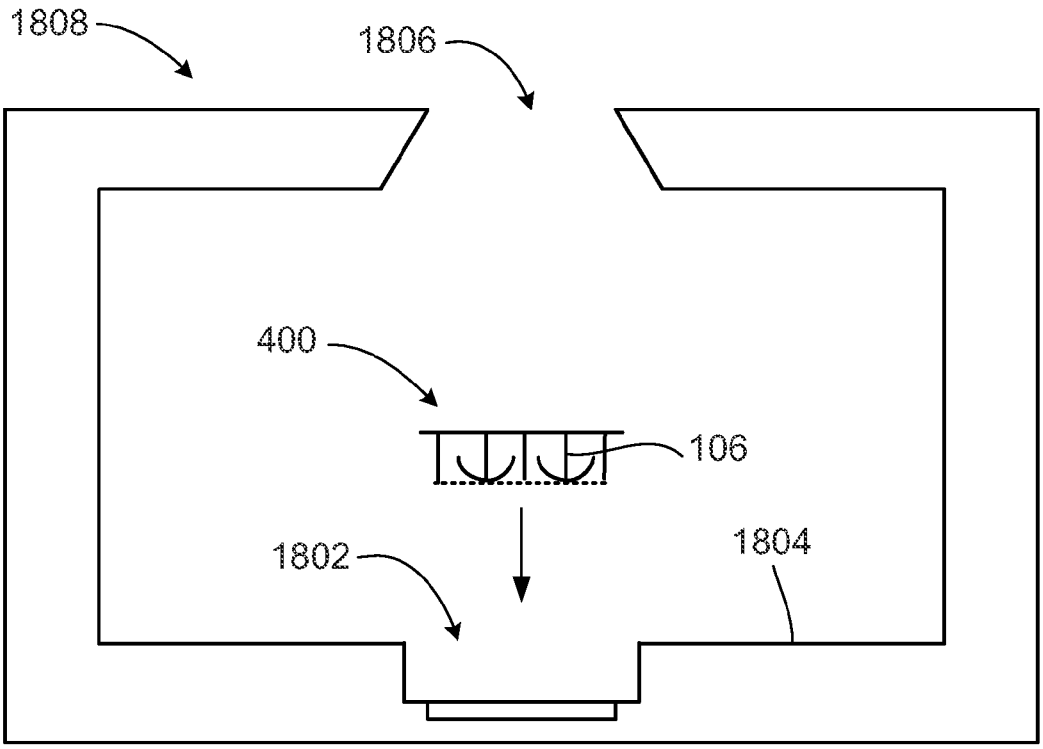
FIGS. 18-20 schematically and sequentially illustrate a process for forming a molded foam cushion with a fastener product embedded in one surface of the cushion.

Referring to FIG. 17, the apparatus and process of FIG. 16 may be modified to mold the fastening product from multiple resins, by extruding two molten resins together into the nip. In this example, a sufficient amount of a molten resin 1702 is extruded into nip 1608 to form walls 104 and fastener elements 106 of the product, while another flow of molten resin 1704 is introduced to the nip to form substrate 102 of the product. The two resins are forced through a cross-head die head 1706 with two different die orifices 1708 and 1710, to join in the nip. A respective pool of each of the resins forms just upstream of the nip. In the nip, resin 1702 is forced into the cavity roller to form the fastener elements and the walls, while resin 1704 is calendered to form the substrate. The pressure in the nip also permanently laminates resin 1702 with resin 1704 to form the finished fastener product. In one example, resin 1704 is a magnetically attractable resin, while resin 1702 is a resin selected for wall and/or fastener element performance. In another example, the amount of each resin flow is modified such that the amount of resin 1702 is sufficient only to fill the head portions of the fastener element cavities and the inner extents of the wall-forming cavities, and is selected to have a lower durometer to provide the finished product with a softer feel and to enhance sealing of the upper wall surfaces against a foaming mold surface. In another example, the amount of each resin flow is adjusted such that resin 1702 fills the cavities and forms the upper surface of the substrate, with resin 1704 forming only the back portion of the substrate.

The fastening products described above may be used in a variety of fastening applications. The arrangements of fastening elements 106 and walls 104 may also be employed on rigid fastening surfaces, such as injection molded fastening products. The following description provides details of two applications of fastening products having the types of fastening face configurations discussed above.

Figure 19:
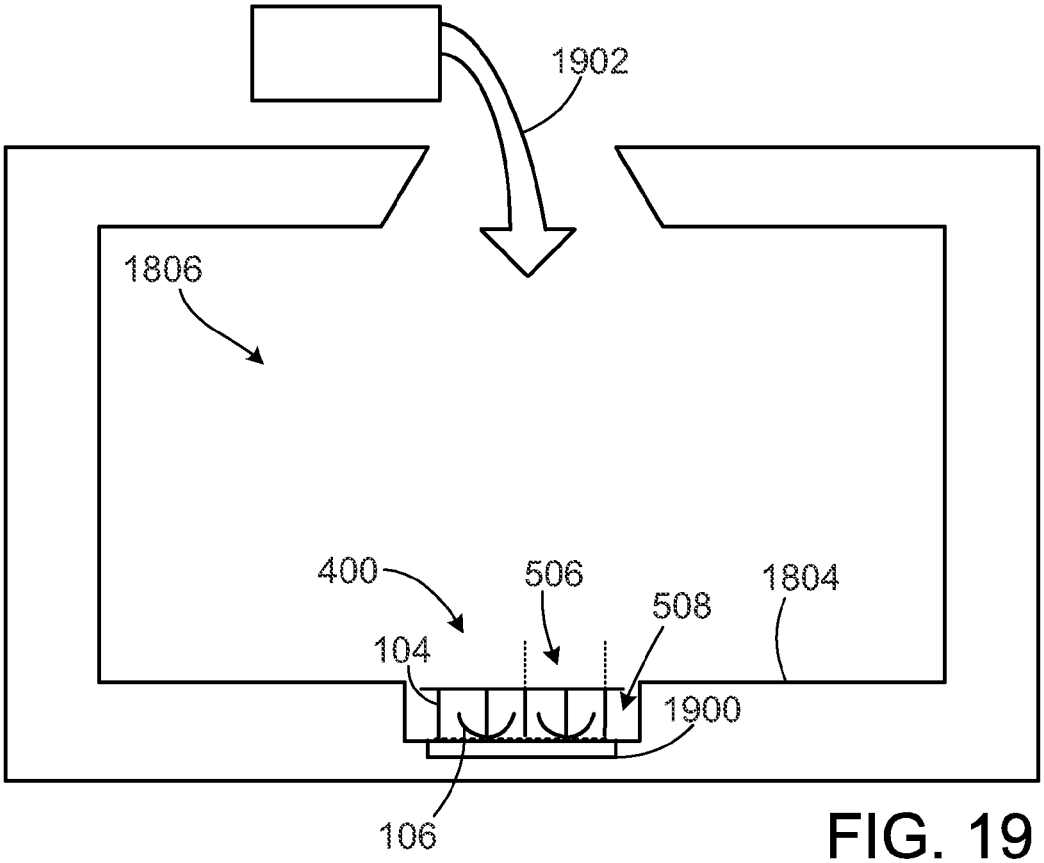

Referring first to FIGS. 18-21, mold-in fastener product 400 is placed into a trench or recess 1802 in an interior wall 1804 defining a boundary of a mold cavity 1806 of a mold 1808. The trench or recess may be specifically shaped to match the shape of the die-cut fastener product, such that any space between the product and the trench walls is consistent about the perimeter of the product. In some cases, edges of the product overlay upper edges of the mold walls bounding the trench. Fastener elements 106 face the wall of the mold. As shown in FIG. 19, the positioned fastener product is held against the mold surface by an embedded magnet 1900 that attracts the fastener product, with walls 104 of the product forming a seal against the wall surface to inhibit flow into closed cells 506 of the product. Magnetic attraction may be due to magnetically attractable resin forming all or part of the fastener product, or may be due to some other magnetically attractable material, such as a metal shim or mesh (not shown), secured to or embedded in the substrate of the product. In some other examples, the fastener product is set on a flat, non-recessed upper surface of a pedestal extending into the mold cavity, and is not surrounded on either side by mold walls, the walls of the product forming a sufficient seal with the upper pedestal surface to inhibit flow into the closed cells.

Figure 20:
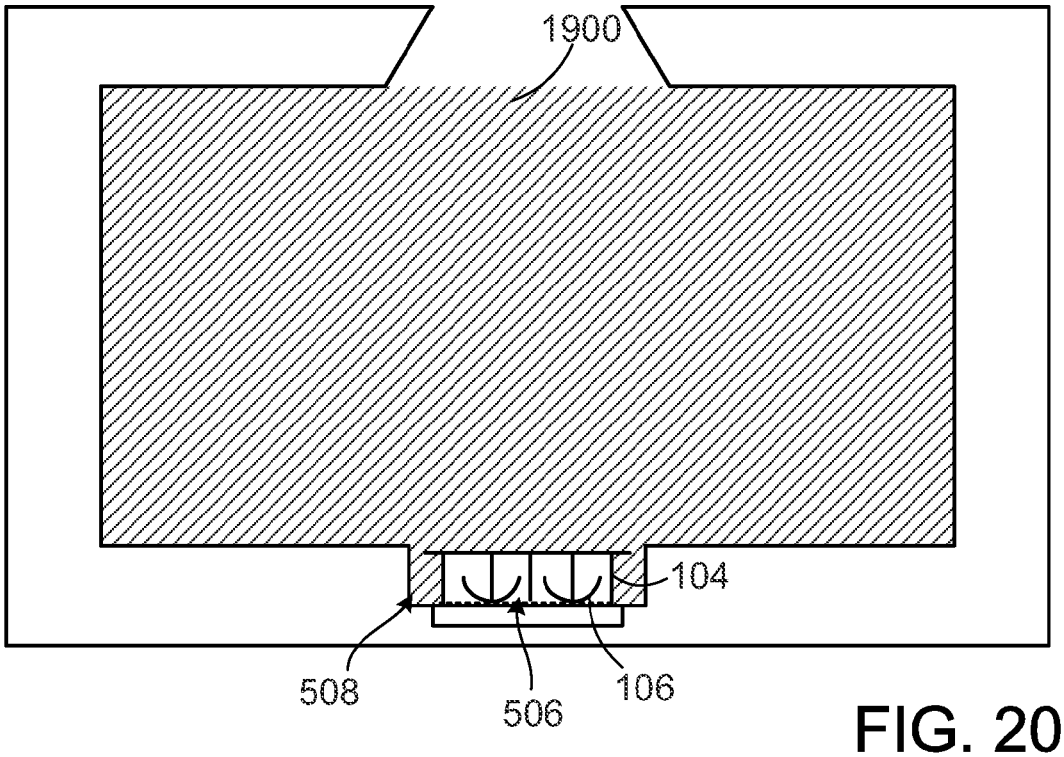

As shown in FIG. 19, a foaming resin 1902 is introduced into the mold cavity 1806 to expand and fill the mold cavity and intrude into any open cells 508 about the perimeter of the fastener product, as shown in FIG. 20. The foaming resin 1902 may constitute a single component, or there may be multiple components that are mixed as they are introduced into the mold cavity, or before. The walls 104 of the fastener product prevent any significant foam intrusion into closed cells 506 of the fastener product.

Figure 21:
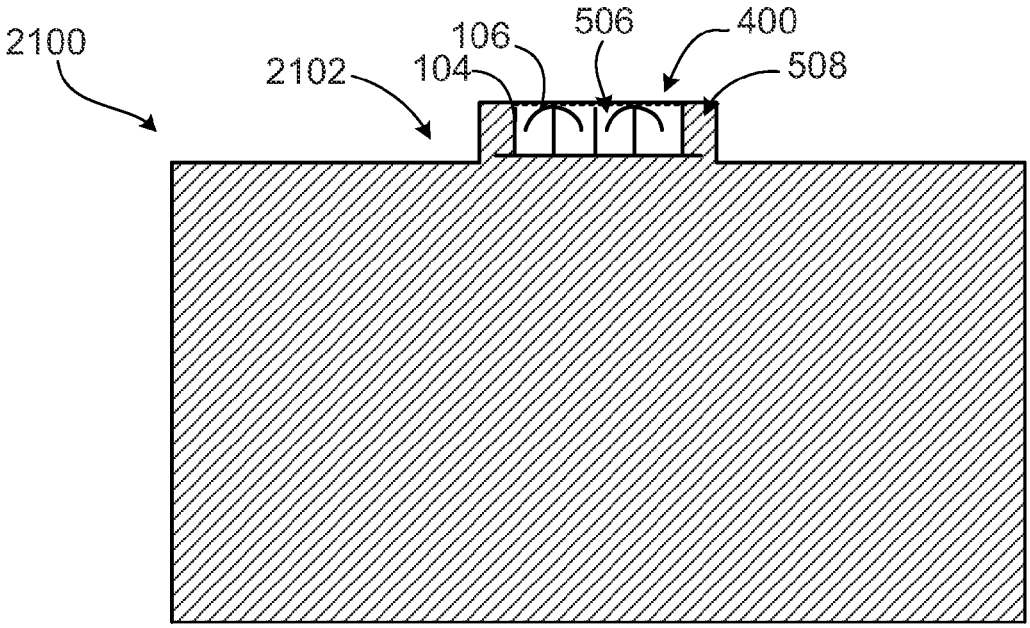
FIG. 21 illustrates a molded foam product formed by the process of FIGS. 18-20.
Figure 22:
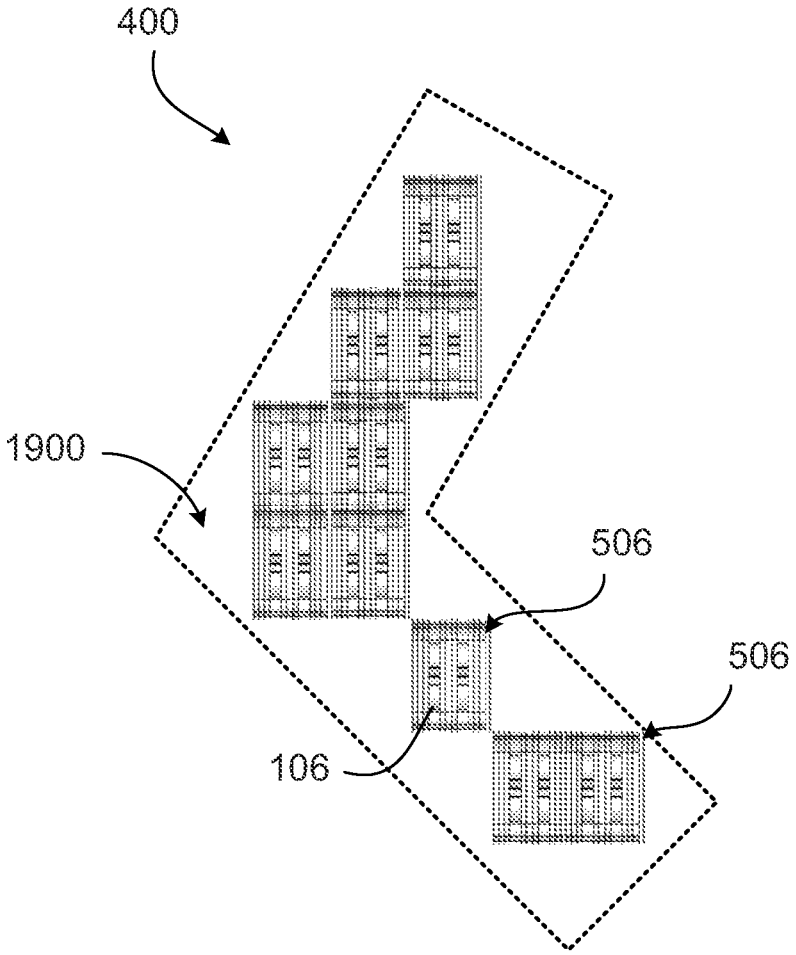
FIG. 22 is a top view of a portion of the surface of the foamed article, showing the fastening product embedded with foam in the open cells of the fastening product.

Referring to FIG. 21, a foamed article 2100, as removed from mold cavity 1806, has mold-in fastener product 400 embedded at a surface 2102 of the foamed article. The perimeter of the fastener product is surrounded by foam, filling open cells 508 about the fastener product, as illustrated in FIG. 22. The walls 104 about closed cells 506 minimize, if not prevent, foaming resin 1902 from entering the closed cells by forming flow barriers, discussed above with respect to FIG. 1. Thus, fastener elements 106 within the closed cells remain exposed and functional to releasable engage with fibers of a mating component (not shown) to form a hook-and-loop fastening.

Figure 23:
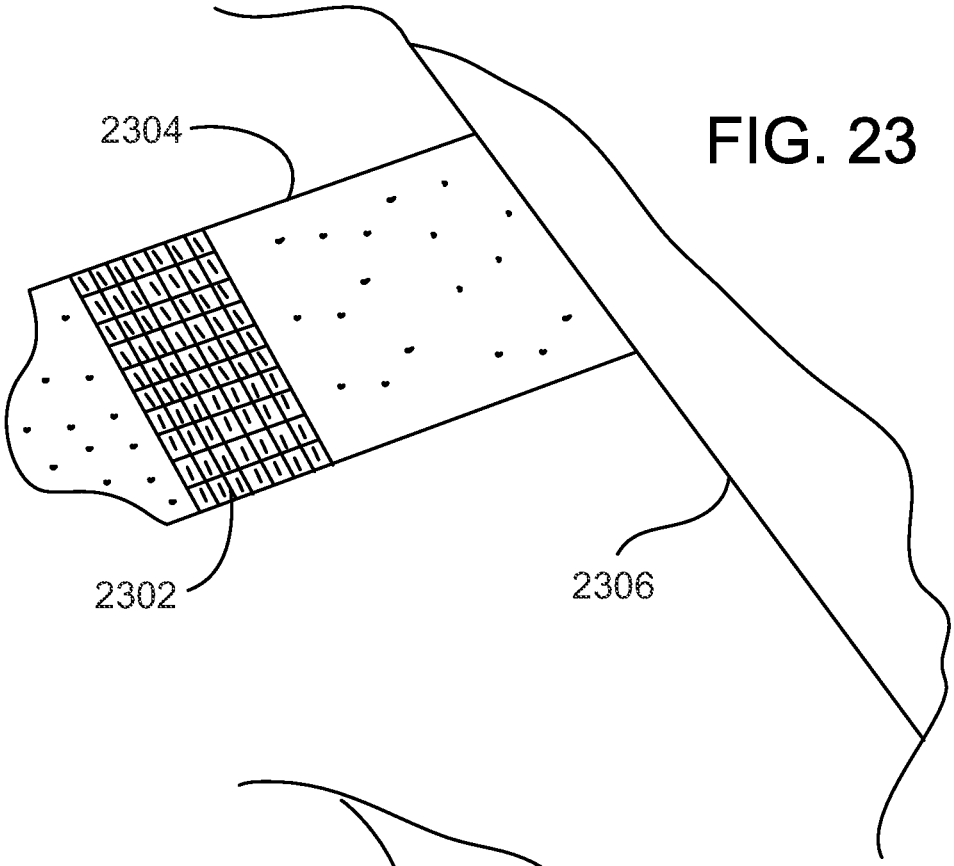
FIGS. 23 and 24 show diaper fastening tabs.
Figure 24:
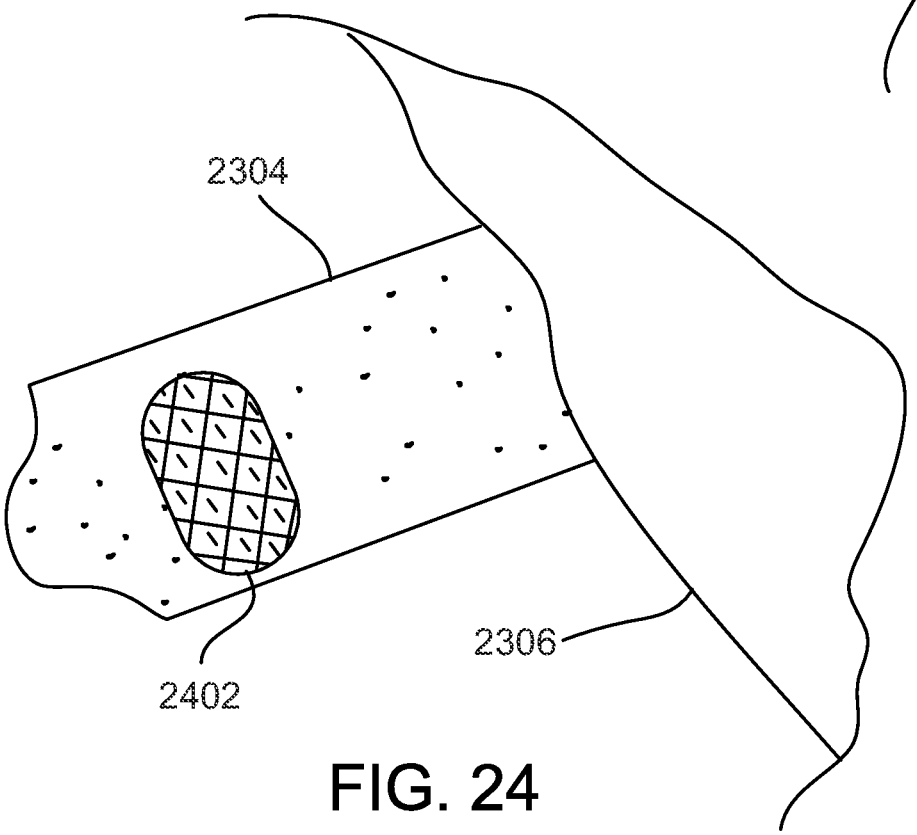
Figure 25:
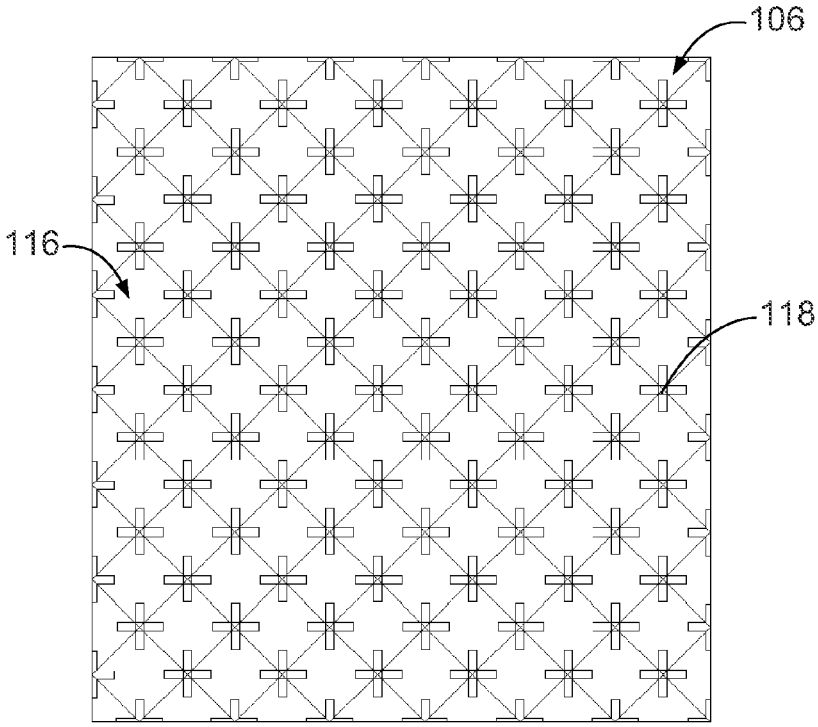
FIG. 25 is a top view of a fastener product with a diamond pattern of cells and hooking members at each wall intersection.

FIGS. 23 and 24 illustrate the use of the various wall 104 and fastener element 106 configurations described above in a garment fastening application. In each figure, the fastener product is provided as a discrete patch of a diaper tab 2304 that is permanently attached to a diaper chassis 2306. In FIG. 23, patch 2302 is a portion of flexible fastening tape that has been either formed directly on a diaper tab substrate material, or bonded to such material after molding. Roll-molding of fastener tape directly onto substrates or backings such as non-woven webs is described, for example, in U.S. Pat. No. 7,048,818, the entirety of which is incorporated herein by reference. Roll-molding is one method for permanently laminating a resin to a preformed sheet of material while molding the resin to form surface features such as fastener elements and/or walls. In this figure, the wall arrangement is shown in a rectilinear array, with fastener elements oriented perpendicular to the longitudinal direction of the tab. However, the arrangement of fastener elements and walls may be according to any of the configurations discussed above. FIG. 24 shows a similar patch 2402, with a diamond pattern of walls. Notably, patch 2402 does not extend to the edges of the diaper tab, but is spaced from the edges so as to avoid the presence of potentially rough fastener tape at the tab edges. These discrete, bounded patches can be die cut and individually secured to diaper tabs, or can be formed as discrete patches directly on the diaper tab material, such as by the methods taught in U.S. Pat. Nos. 7,056,462, 7,794,638 or 7,244,382, the entire contents of all three of which are hereby incorporated by reference.

A number of embodiments of the invention have been described. Nevertheless, it will be understood that various modifications may be made without departing from the spirit and scope of the invention. Accordingly, other embodiments are within the scope of the following claims.

What is claimed is:

1. A fastening product, comprising:

a flexible, sheet-form substrate having a surface;

a plurality of walls extending from the surface and defining therebetween an array of cells bounded by the walls such that the walls separate adjacent cells of the array, the substrate forming a floor of each cell; and a plurality of fastener elements extending from the surface and interspersed among the cells, the fastener elements having heads spaced above the surface to define loop engagement overhangs disposed within the cells, wherein the cells of the array are arranged in columns and rows, each column and each row comprising at least three of the cells, such that there exists at least one closed path within the substrate that fully circumscribes at least one of the cells;

wherein the walls are configured to form flow barriers between adjacent cells when the fastening product is held against a flat surface with the fastener elements extending from the substrate towards the flat surface; and wherein the walls and the fastener elements together comprise a contiguous mass of a resin.

2. The fastening product of claim 1, wherein at least some of the walls are continuous.

3. The fastening product of claim 1, wherein at least some of the fastener elements are embedded in the walls, with heads of the embedded fastener elements extending into adjacent cells.

4. The fastening product of claim 1, wherein the walls are configured to define a maximum flow gap into the cells, with the product held against a flat surface with the fastener elements extending from the substrate toward the flat surface, of less than about 0.1 millimeter.

5. The fastening product of claim 1, wherein the substrate has lateral edges bounding the surface, with the plurality of walls extending to all of the lateral edges of the substrate and partially bounding cells open at the lateral edges of the substrate.

6. The fastening product of claim 5, wherein at least some of the partially bounded cells open at the lateral edges of the substrate contain fastener elements.

7. The fastening product of claim 1, wherein the walls are taller than the fastener elements, as measured from the surface of the substrate.

8. The fastening product of claim 1, wherein each of the cells includes at least one fastener element.

9. The fastening product of claim 2, wherein the walls comprise continuous walls extending in two orthogonal directions.

10. The fastening product of claim 1, wherein the walls and the fastener elements extend from the surface of the substrate to a substantially common height.

11. The fastening product of claim 1, wherein at least some of the cells are void of fastener elements.

12. A method of forming a discrete fastener, the method comprising:

providing a flexible, sheet-form product comprising:

a flexible, sheet-form substrate having a surface;

a plurality of walls extending from the surface and defining therebetween an array of cells bounded by the walls such that the walls separate adjacent cells of the array, the substrate forming a floor of each cell; and a plurality of fastener elements extending from the surface and interspersed among the cells, the fastener elements having heads spaced above the surface to define loop engagement overhangs disposed within the cells, wherein the cells of the array are arranged in columns and rows, each column and each row comprising at least three of the cells, such that there exists at least one closed path within the substrate that fully circumscribes at least one of the cells; and severing the flexible, sheet-form product to form a discrete fastener having at least one cell fully bounded by the walls and a perimeter defined by severed edges of the substrate, the walls extending to the perimeter of the fastener to partially bound cells of the array open at the severed edges.

13. The method of claim 12, wherein at least some of the open cells at the severed edges contain loop engagement overhangs that define anchor points at the perimeter of the fastener.

14. The method of claim 12, wherein severing the product severs walls at the severed edges.

15. The method of claim 12, wherein open cells are formed at the severed edges.

16. A fastening product, comprising:

a flexible, sheet-form substrate having a surface;

a plurality of walls extending from the surface and defining therebetween an array of cells bounded by the walls such that the walls separate adjacent cells of the array, the substrate forming a floor of each cell; and a plurality of fastener elements extending from the surface and interspersed among the cells, the fastener elements having heads spaced above the surface to define loop engagement overhangs disposed within the cells, wherein the cells of the array are arranged in columns and rows, each column and each row comprising at least three of the cells, such that there exists at least one closed path within the substrate that fully circumscribes at least one of the cells, wherein at least some of the fastener elements are embedded in the walls, with heads of the embedded fastener elements extending into adjacent cells.

17. A fastening product, comprising:

a flexible, sheet-form substrate having a surface;

a plurality of walls extending from the surface and defining therebetween an array of cells bounded by the walls such that the walls separate adjacent cells of the array, the substrate forming a floor of each cell; and a plurality of fastener elements extending from the surface and interspersed among the cells, the fastener elements having heads spaced above the surface to define loop engagement overhangs disposed within the cells, wherein the cells of the array are arranged in columns and rows, each column and each row comprising at least three of the cells, such that there exists at least one closed path within the substrate that fully circumscribes at least one of the cells, wherein the substrate has lateral edges bounding the surface, with the plurality of walls extending to all of the lateral edges of the substrate and partially bounding cells open at the lateral edges of the substrate.

18. The fastening product of claim 17, wherein at least some of the partially bounded cells open at the lateral edges of the substrate contain fastener elements.

19. A fastening product, comprising:

a flexible, sheet-form substrate having a surface;

a plurality of walls extending from the surface and defining therebetween an array of cells bounded by the walls such that the walls separate adjacent cells of the array, the substrate forming a floor of each cell; and a plurality of fastener elements extending from the surface and interspersed among the cells, the fastener elements having heads spaced above the surface to define loop engagement overhangs disposed within the cells, wherein the cells of the array are arranged in columns and rows, each column and each row comprising at least three of the cells, such that there exists at least one closed path within the substrate that fully circumscribes at least one of the cells, wherein the walls are taller than the fastener elements, as measured from the surface of the substrate.

20. A fastening product, comprising:

a flexible, sheet-form substrate having a surface;

a plurality of walls extending from the surface and defining therebetween an array of cells bounded by the walls such that the walls separate adjacent cells of the array, the substrate forming a floor of each cell; and a plurality of fastener elements extending from the surface and interspersed among the cells, the fastener elements having heads spaced above the surface to define loop engagement overhangs disposed within the cells, wherein the cells of the array are arranged in columns and rows, each column and each row comprising at least three of the cells, such that there exists at least one closed path within the substrate that fully circumscribes at least one of the cells, wherein the walls and the fastener elements extend from the surface of the substrate to a substantially common height.

21. A fastening product, comprising:

a flexible, sheet-form substrate having a surface;

a plurality of walls extending from the surface and defining therebetween an array of cells bounded by the walls such that the walls separate adjacent cells of the array, the substrate forming a floor of each cell; and a plurality of fastener elements extending from the surface and interspersed among the cells, the fastener elements having heads spaced above the surface to define loop engagement overhangs disposed within the cells, wherein the cells of the array are arranged in columns and rows, each column and each row comprising at least three of the cells, such that there exists at least one closed path within the substrate that fully circumscribes at least one of the cells, wherein at least some of the cells are void of fastener elements.

* * * * *